US008684498B2

(12) United States Patent
Kuwata

(10) Patent No.: US 8,684,498 B2
(45) Date of Patent: Apr. 1, 2014

(54) LIQUID EJECTION HEAD AND IMAGE FORMING APPARATUS INCLUDING SAME

(75) Inventor: Masahiro Kuwata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/615,331

(22) Filed: Sep. 13, 2012

(65) Prior Publication Data

US 2013/0070025 A1 Mar. 21, 2013

(30) Foreign Application Priority Data

Sep. 16, 2011 (JP) ..... 2011-203647

(51) Int. Cl.
*B41J 2/14* (2006.01)

(52) U.S. Cl.
USPC ..... 347/47

(58) Field of Classification Search
USPC ..... 347/47
See application file for complete search history.

(56) References Cited

U.S. PATENT DOCUMENTS

| | | | | |
|---|---|---|---|---|
| 5,489,930 | A * | 2/1996 | Anderson | 347/71 |
| 2005/0110834 | A1* | 5/2005 | Norkitis et al. | 347/47 |
| 2011/0080453 | A1* | 4/2011 | Nagashima | 347/56 |

FOREIGN PATENT DOCUMENTS

| | | |
|---|---|---|
| JP | 2005-1211 | 1/2005 |
| JP | 2005-34998 | 2/2005 |
| JP | 2007-326226 | 12/2007 |

* cited by examiner

*Primary Examiner* — Matthew Luu
*Assistant Examiner* — Alexander D Shenderov
(74) *Attorney, Agent, or Firm* — Cooper & Dunham LLP

(57) ABSTRACT

A liquid ejection head including a nozzle plate having a nozzle array constructed of multiple nozzles from which liquid droplets are ejectable; a channel plate in which grooves that form part of multiple pressure chambers respectively communicating with the multiple nozzles are provided with partition walls interposed therebetween, a wall member that covers the grooves to form part of walls of the pressure chambers, and multiple first through-holes formed in the channel plate to connect the nozzles and the pressure chambers, respectively. The multiple first through-holes are provided with partition walls interposed therebetween, and each of the multiple first through-holes has a first opening and a second opening. The second opening is offset from the first opening in a direction in which the nozzle arrays extend. Each of the multiple first through-holes further has a portion between the first and second openings to change a direction of flow of liquid.

11 Claims, 28 Drawing Sheets

LIQUID EJECTION HEAD AND IMAGE FORMING APPARATUS INCLUDING SAME

CROSS-REFERENCE TO RELATED APPLICATION

The present patent application is based on and claims priority pursuant to 35 U.S.C. §119 from Japanese Patent Application No. 2011-203647, filed on Sep. 16, 2011 in the Japan Patent Office, which is incorporated by reference herein in its entirety.

BACKGROUND OF THE INVENTION

1. Field of the Invention

Exemplary aspects of the present invention generally relate to a liquid ejection head and an image forming apparatus including the liquid ejection head.

2. Description of the Related Art

One type of image forming apparatus such as a printer, copier, plotter, facsimile machine, or multifunction device having two or more of these capabilities is an inkjet recording device employing a liquid ejection recording method. The inkjet recording device includes a recording head constructed of a liquid ejection head that ejects droplets of a recording liquid such as ink onto a sheet of a recording medium to form an image on the sheet.

The liquid ejection head is generally constructed of a nozzle plate in which multiple nozzles that eject liquid droplets are formed, a channel plate in which grooves that form part of multiple pressure chambers respectively communicating with the multiple nozzles are formed with partition walls interposed between the grooves, and a wall member such as a vibration plate that covers the grooves to form part of walls of the pressure chambers and a substrate provided with a heat element. The channel plate has through-holes that connect the pressure chambers and the nozzles, respectively.

Increasing demand for higher quality images at higher speed increases the number and density of the nozzles formed in the liquid ejection head, and therefore, each of the partition walls provided between channels, each constructed of the through-hole, the pressure chamber, and so forth, tends to be thin.

The thin partition walls between the channels cause adjacent channel crosstalk, in which pressure applied to a target pressure chamber to eject liquid droplets adversely affects other pressure chambers adjacent to the target pressure chamber and causes pressure fluctuation also in the adjacent pressure chambers. Consequently, liquid droplets are not properly ejected from the nozzles, or liquid droplets are ejected from nozzles provided corresponding to the pressure chambers which are not supposed to eject liquid droplets, thereby degrading image quality.

In order to prevent deformation of the partition walls respectively provided between the adjacent through-holes, there is known a technique in which one of the two adjacent through-holes is shaped like a crank and the through-holes are provided in a zigzag pattern in a direction of nozzle arrays each constructed of the multiple nozzles. In another approach, two types of through-holes, that is, first and second through-holes, are provided and one of the first and second through-holes is provided at a slant.

However, both approaches have drawbacks.

In the case in which one of the two adjacent through-holes is shaped like a crank, channels respectively constructed of the two adjacent pressure chambers have a different shape from the pressure chambers to the nozzles, thereby varying liquid ejection performance between the adjacent pressure chambers.

In the case in which one of the first and second through-holes is provided at a slant, provision of the two types of the through-holes for the single pressure chamber complicates the configuration. In addition, because the volume of each of the pressure chambers needs to be increased, speed of pressure response is decreased. As a result, it is difficult to drive the liquid ejection head with high frequency.

BRIEF SUMMARY OF THE INVENTION

In view of the foregoing, illustrative embodiments of the present invention provide a novel liquid ejection head having an uncomplicated configuration in which each of pressure chambers has the same liquid ejection performance and adjacent channel crosstalk is reduced, and an image forming apparatus including the liquid ejection head.

In one illustrative embodiment, a liquid ejection head includes a nozzle plate having a nozzle array constructed of multiple nozzles from which liquid droplets are ejectable, a channel plate in which grooves that form part of multiple pressure chambers respectively communicating with the multiple nozzles are provided with partition walls interposed between the grooves, a wall member that covers the grooves to form part of walls of the pressure chambers, and multiple first through-holes formed in the channel plate throughout a thickness of the channel plate to connect the multiple nozzles and the multiple pressure chambers, respectively. The multiple first through-holes are provided with partition walls interposed therebetween, and each of the multiple first through-holes has a first opening facing the wall member and a second opening facing the nozzle plate. The second opening is offset from the first opening in a direction in which the nozzle arrays extend. Each of the multiple first through-holes further has a portion between the first and second openings to change a direction of flow of liquid.

In another illustrative embodiment, a liquid ejection head includes a nozzle plate having a nozzle array constructed of multiple nozzles from which liquid droplets are ejectable, a channel plate in which grooves that form part of multiple pressure chambers respectively communicating with the multiple nozzles are provided with partition walls interposed between the grooves, a wall member that covers the grooves to form part of walls of the pressure chambers, and multiple first through-holes formed in the channel plate throughout a thickness of the channel plate to connect the multiple nozzles and the multiple pressure chambers, respectively. The multiple first through-holes are provided with partition walls interposed therebetween, and each of the multiple first through-holes has a first opening facing the wall member and a second opening facing the nozzle plate. The second opening is offset from the first opening in a direction perpendicular to a direction in which the nozzle arrays extend. Each of the multiple first through-holes further has a portion between the first and second openings to change a direction of flow of liquid. The second openings of two adjacent first through-holes are offset from the first openings in opposite directions, respectively, in the direction perpendicular to the direction in which the nozzle arrays extend.

In yet another illustrative embodiment, a liquid ejection head includes a nozzle plate having a nozzle array constructed of multiple nozzles from which liquid droplets are ejectable, a channel plate in which grooves that form part of multiple pressure chambers respectively communicating with the multiple nozzles are provided with partition walls interposed between the grooves, a wall member that covers the grooves to form part of walls of the pressure chambers, multiple first through-holes formed in the channel plate throughout a thickness of the channel plate to connect the multiple nozzles and the multiple pressure chambers, respectively, and multiple second through-holes formed in the channel plate throughout the thickness of the channel plate to form part of channels through which the liquid is supplied to the pressure chambers. The multiple first through-holes are provided with partition walls interposed therebetween, and each of the multiple first through-holes has a first opening facing the wall member and a second opening facing the nozzle plate. The second opening is offset from the first opening in a direction perpendicular to a direction in which the nozzle arrays extend. Each of the multiple first through-holes further has a portion between the first and second openings to change a direction of flow of liquid. The multiple second through-holes are provided with partition walls interposed therebetween, and each of the multiple second through-holes has a first opening facing the wall member and a second opening facing the nozzle plate. The second opening is offset from the first opening in the direction perpendicular to the direction in which the nozzle arrays extend. Each of the multiple second through-holes further has a portion between the first and second openings to change the direction of flow of the liquid. In each of the pressure chambers, the second openings of the first and second through-holes are offset from the first openings of the first and second through-holes, respectively, either toward or away from each other in the direction perpendicular to the direction in which the nozzle arrays extend.

In still yet another illustrative embodiment, an image forming apparatus includes the liquid ejection head described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 49(*b*) is a vertical cross-sectional view along a line X1-X1 in FIG. 49(*a*);

FIG. 50(*b*) is a vertical cross-sectional view along a line X1-X1 in FIG. 50(*a*);

FIG. 51(*h*) is a vertical cross-sectional view along a line X1-X1 in FIG. 51(*a*);

FIG. 52(*b*) is a vertical cross-sectional view along a line X1-X1 in FIG. 52(*a*);

FIG. 53(*b*) is a vertical cross-sectional view along a line X1-X1 in FIG. 53(*a*);

FIG. 54(*b*) is a vertical cross-sectional view along a line X1-X1 in FIG. 54(*a*);

FIG. 55(*b*) is a vertical cross-sectional view along a line X1-X1 in FIG. 55(*a*);

DETAILED DESCRIPTION OF ILLUSTRATIVE EMBODIMENTS

Figure 1:
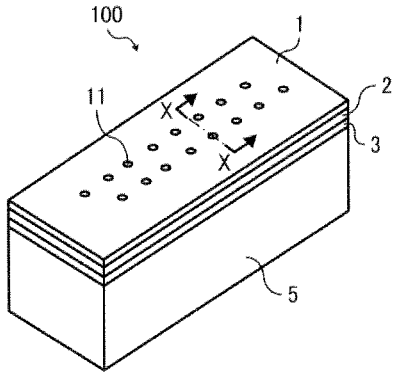
FIG. 1 is a perspective view illustrating the external appearance of an example of a liquid ejection head according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a "sheet" of recording media is not limited to a sheet of paper but also includes any material onto which liquid droplets including ink droplets adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns.

In addition, ink includes any material which is a liquid when ejected from the image forming apparatuses to form images on the recording medium, such as a DNA sample, a resist material, a pattern material, and resin.

Further, an image formed on the recording medium is not limited to a fiat image, but also includes an image formed on a three-dimensional object, a three-dimensional image, and so forth.

Figure 2:
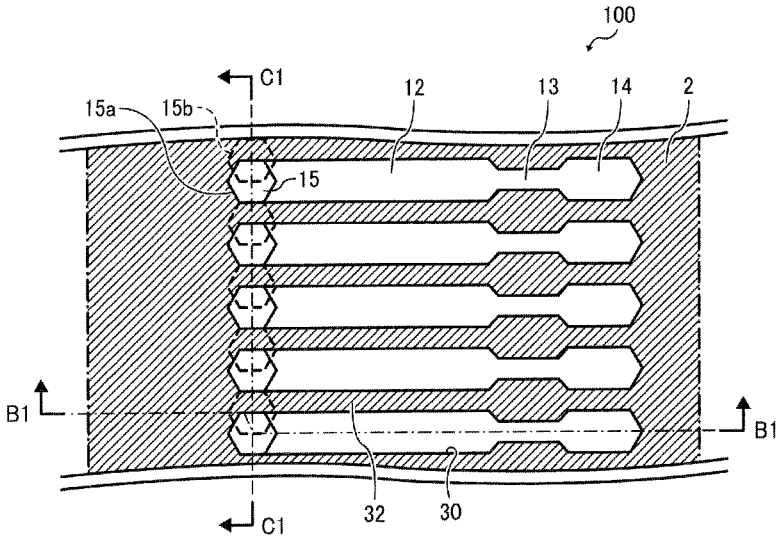
FIG. 2 is a horizontal cross-sectional view along a line A1-A1 in FIG. 3, illustrating an example of a configuration of the liquid ejection head according to the first illustrative embodiment.
Figure 3:
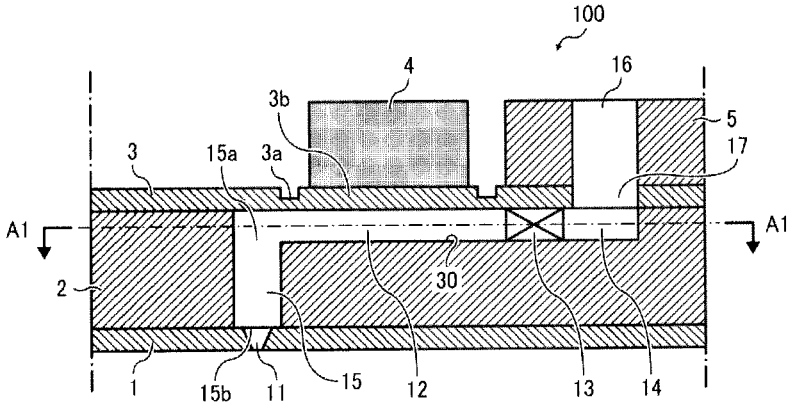
FIG. 3 is a vertical cross-sectional view along a line B1-B1 in FIG. 2.

A description is now given of a configuration and operation of a liquid ejection head 100 according to a first illustrative embodiment, with reference to FIGS. 1 to 3. FIG. 1 is a perspective view illustrating the external appearance of an example of the liquid ejection head 100. FIG. 2 is a horizontal cross-sectional view along a line A1-A1 in FIG. 3, illustrating an example of a configuration of the liquid ejection head 100 according to the first illustrative embodiment. FIG. 3 is a vertical cross-sectional view along a line B1-B1 in FIG. 2, which corresponds to a cross-section along a line X-X in FIG. 1. It is to be noted that FIG. 1 illustrates the liquid ejection head 100 in a state in which liquid droplets are ejected upward, whereas FIG. 3 illustrates the liquid ejection head 100 in a state in which liquid droplets are ejected downward.

In the liquid ejection head 100, a nozzle plate 1, a channel plate 2, and a wall member, which, in the present illustrative embodiment, is a vibration plate 3, are laminated and bonded together, with the channel plate 2 between the nozzle plate 1 and the vibration plate 3. A piezoelectric member 4 and a common liquid chamber member 5 are disposed facing a side of the vibration plate 3 opposite a side thereof facing the channel plate 2.

Multiple nozzles 11 from which liquid droplets are ejected are formed in a zigzag pattern in the nozzle plate 1 so that two nozzle rows or arrays, each constructed of the multiple nozzles 11, are formed in the nozzle plate 1, one array offset from the other. The nozzle plate 1 is formed of stainless steel in which the nozzles 11 are formed by stamping. Alternatively, the nozzle plate 1 may be formed of nickel plating, resin such as a polyimide resin film, silicon, or a combination of these materials. A nozzle face of the nozzle plate 1 in which the multiple nozzles 11 are formed is provided with a water-repellent film such as a plating film and a water-repellent coating, using a well-known method. The nozzle plate 1 is bonded to the channel plate 2 with adhesive.

Grooves 30, each constituting a pressure chamber 12 that communicates with the corresponding nozzle 11, a fluid resistor 13 that supplies liquid to the corresponding pressure chamber 12, and an inlet 14 provided at an upstream portion of the fluid resistor 13 in a direction of flow of the liquid, are formed in the channel plate 2. In addition, first through-holes 15 that connect the pressure chambers 12 and the nozzles 11, respectively, are formed in the channel plate 2. The channel plate 2 is formed by etching a monocrystalline silicon substrate.

The vibration plate 3 covers the grooves 30 formed in the channel plate 2 so that part of walls of the pressure chambers 12 and so forth are formed. The vibration plate 3 has displaceable vibrating portions 3*a*, each forming part of the walls of the pressure chambers 12 and having a protrusion 3*b*. An actuator, which, in the present illustrative embodiment, is the piezoelectric member 4, is bonded to the protrusions 3*b*.

An opening 17 that connects a common liquid chamber 16 formed in the common liquid chamber member 5 and each of the inlets 17 formed in the channel plate 2 is formed in the vibration plate 3. The vibration plate 3 has a double-layer structure and is formed by nickel plating.

Grooves are formed in a laminate-type piezoelectric member bonded to a base member, not shown, by half-cut dicing so that multiple piezoelectric columns are formed at predetermined intervals to provide the piezoelectric member 4.

The common liquid chamber member 5 constitutes a part of the frame of the liquid ejection head 100, and forms the common liquid chamber 16 that accommodates liquid supplied externally and supplies the liquid to each of the pressure chambers 12.

In the liquid ejection head 100 having the above-described configuration, a voltage supplied to the piezoelectric member 4 is reduced from a reference level to contract the piezoelectric member 4 so that the vibrating portions 3*a* of the vibration plate 3 are deformed to expand the volume of each of the pressure chambers 12. Accordingly, liquid flows into the pressure chambers 12. Thereafter, the voltage supplied to the piezoelectric member 4 is increased to extend the piezoelectric member 4 in a direction of lamination so that the vibrating portions 3*a* of the vibration plate 3 are deformed toward the nozzles 11 to contract the volume of each of the pressure chambers 12. As a result, pressure is applied to the liquid within the pressure chambers 12 so that liquid droplets are ejected from the nozzles 11.

Then, the voltage supplied to the piezoelectric member 4 is returned to the reference level to restore the vibrating portions 3*a* of the vibration plate 3 to their initial positions so that the pressure chambers 12 are once again expanded, thereby generating negative pressure. As a result, the liquid flows from the common liquid chamber 16 to the pressure chambers 12 to fill the pressure chambers 12. After vibration of a meniscus formed in each of the nozzles 11 is damped, the next series of ejection of liquid droplets is started.

It is to be noted that the method for driving the liquid ejection head 100 is not limited to the above-described example, and may be varied depending on the exact manner in which the drive waveform is applied.

Figure 4A:
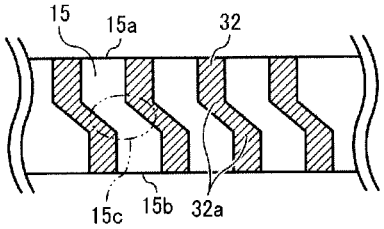
FIG. 4A is a vertical cross-sectional view along a line C1-C1 in FIG. 2, illustrating a first example of a first through-hole formed in the liquid ejection head.
Figure 4B:
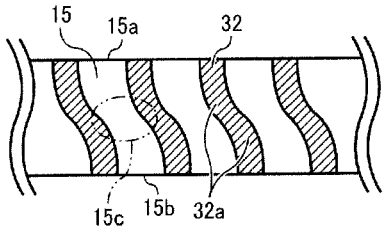
FIG. 4B is a vertical cross-sectional view along the line C1-C1 in FIG. 2, illustrating a second example of a first through-hole formed in the liquid ejection head.

A description is now given of a configuration of the first through-holes 15 formed in the channel plate 2 of the liquid ejection head 100 according to the first illustrative embodiment, with reference to FIGS. 4A and 4B. FIG. 4A is a vertical cross-sectional view along a line C1-C1 in FIG. 2, illustrating a first example of the first through-holes 15 formed in the liquid ejection head 100 according to the first illustrative embodiment. FIG. 4B is a vertical cross-sectional view taken along the line C1-C1 in FIG. 2, illustrating a second example of the first through-holes 15 formed in the liquid ejection head 100 according to the first illustrative embodiment.

In the channel plate 2, the multiple first through-holes 15 that connect the nozzles 11 and the pressure chambers 12, respectively, are formed throughout the thickness of the channel plate 2 with partition walls 32 interposed therebetween, respectively.

Each of the first through-holes 15 has a first opening 15*a* facing the vibration plate 3 and a second opening 15*b* facing the nozzle plate 1. The second opening 15*b* is disposed offset from the first opening 15*a* in the direction of the nozzle arrays.

Each of the first through-holes 15 further has a bent portion 15*c* between the first and second openings 15*a* and 15*b* that changes the direction of flow of the liquid. In the first example illustrated in FIG. 4A, each of the first through-holes 15 is bent at the bent portion 15*c* in the direction of the nozzle arrays. In the second example illustrated in FIG. 4B, each of the first through-holes 15 is bent at the bent portion 15*c* with curvature in the direction of the nozzle arrays. Thus, each of the first through-holes 15 may be either bent or curved at the bent portion 15*c* as illustrated in FIG. 4A or 4B.

Accordingly, bent portions 32*a* are formed in each of the partition walls 32 between the vibration plate 3 and the nozzle plate 1.

Provision of the bent portions 32*a* to the partition walls 32 can increase a geometrical moment of inertia of each of the partition walls 32 each having an even thickness, thereby increasing rigidity of the partition walls 32.

Because the bent portions 32*a* of the partition walls 32 can increase the rigidity of the partition walls 32 as described above, deformation of the partition walls 32*a* due to pressure fluctuation in the first through-holes 15 can be reduced even when the partition walls 32 respectively formed between the adjacent first through-holes 15 are thin in order to increase the density of the first through-holes 15 and thus of the nozzles 11. As a result, occurrence of adjacent channel crosstalk can be reduced.

Figure 5:
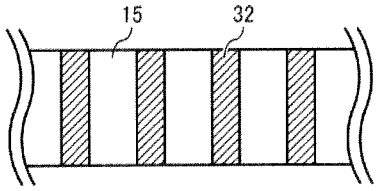
FIG. 5 is a vertical cross-sectional view illustrating a first through-hole and a partition wall respectively formed in a liquid ejection head according to a comparative example.

FIG. 5 is a vertical cross-sectional view illustrating the first through-holes 15 and the partition walls 32 formed in a liquid ejection head according to a comparative example. In the comparative example, each of the first through-holes 15 has a straight shape, and thus each of the partition walls 32 is flat, with even thickness throughout when viewed in a cross-section along the direction of the nozzle arrays.

In such a configuration, the partition walls 32 respectively formed between the adjacent first through-holes 15 need to be thin in the direction of the nozzle arrays in order to increase the density of the first through-holes 15 and thus of the nozzles 11.

Consequently, pressure fluctuation in the first through-holes 15 may deform the partition walls 32 and a part of pressure increased for ejection of liquid droplets may be released due to the deformation of the partition walls 32, possibly causing irregular ejection of the liquid droplets from the target nozzles 11. In addition, pressure increased by deformation of the partition walls 32 may cause irregular ejection of liquid droplets from the nozzles 11 adjacent to the target nozzles 11. In other words, adjacent channel crosstalk, in which a state of the channels adjacent to the target channels adversely affects liquid ejection performance of the target channels, may occur.

When adjacent channel crosstalk is too high, liquid droplets may not be ejected at a predetermined speed or with a predetermined size from the nozzles 11, thereby considerably degrading image quality.

In addition, deformation of the partition walls 32 causes pressure fluctuation in channels which are not supposed to eject liquid droplets and are disposed adjacent to target channels which are supposed to eject liquid droplets. Consequently, liquid droplets may be ejected from the channels which are not supposed to eject the liquid droplets, thereby considerably degrading image quality.

Further, pressure fluctuation in the channels which are supposed to eject liquid droplets or the adjacent channels may differ from a predetermined level due to the deformation of the partition walls 32. Consequently, very minute liquid droplets, that is, mist, may be ejected from the nozzles 11. Because the mist floats within an image forming apparatus 200 including the liquid ejection head 100 and may adhere to a portion which should be clean, problems such as electrical short-circuiting within the liquid ejection head 100 or erroneous detection of an encoder may occur.

By contrast, the configuration according to the first illustrative embodiment can minimize variation in ejection performance between the adjacent nozzles 11 and reduce adjacent channel crosstalk, thereby providing higher-quality images.

Figure 6:
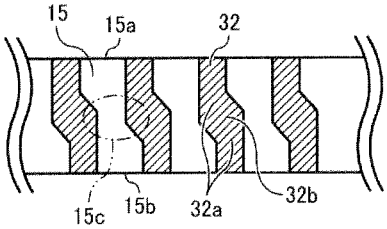
FIG. 6 is a vertical cross-sectional view illustrating an example of a configuration of a liquid ejection head according to a second illustrative embodiment.

A description is now given of a configuration of the liquid ejection head 100 according to a second illustrative embodiment, with reference to FIG. 6. FIG. 6 is a vertical cross-sectional view illustrating the first through-holes 15 and the partition walls 32 formed in the channel plate 2 of the liquid ejection head 100 according to the second illustrative embodiment.

In the second illustrative embodiment, a depth of each of the first and second openings 15*a* and 15*h* of the first through-holes 15 is shallower compared to the first illustrative embodiment so that a thick portion 32*h* is formed at the center of each of the partition walls 32 between the bent portions 32*a*.

In a similar manner to the first illustrative embodiment, each of the partition walls 32 has the bent portions 32*a* so as to have larger geometrical moment of inertia, thereby increasing rigidity of the partition walls 32. In addition, the thick portion 32*b* formed at the center of each of the partition walls 32 further increases the rigidity of the partition walls 32. As a result, deformation of the partition walls 32 due to pressure in the first through-holes 15 can be further reduced, thereby further preventing adjacent channel crosstalk.

The shallow first and second openings 15*a* and 15*b* can be easily formed by shortening etching time in a case of producing the channel plate 2 by etching.

Figure 7:
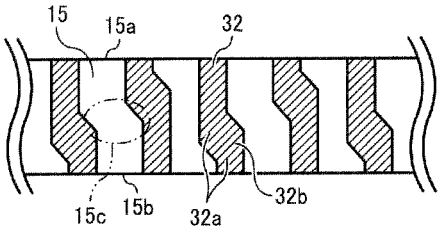
FIG. 7 is a vertical cross-sectional view illustrating an example of a configuration of a liquid ejection head according to a third illustrative embodiment.

A description is now given of a configuration and operation of the liquid ejection head 100 according to a third illustrative embodiment, with reference to FIG. 7. FIG. 7 is a vertical cross-sectional view illustrating the first through-holes 15 and the partition walls 32 formed in the channel plate 2 of the liquid ejection head 100 according to the third illustrative embodiment.

In the third illustrative embodiment, the thick portions 32*b* of the partition walls 32 adjacent to each other in the direction of the nozzle arrays are alternately offset from each other in the direction of thickness of the channel plate 2 (hereinafter also referred to as a vertical direction).

In the second illustrative embodiment described above, a part of each of the first through-holes 15 is narrowed by the thick portions 32*b* of the partition walls 32, respectively. By contrast, in the third illustrative embodiment, the thick portions 32*b* of the partition walls 32 are alternately offset from each other in the vertical direction so as not to narrow the center of each of the first through-holes 15 in the vertical direction.

Figure 8:
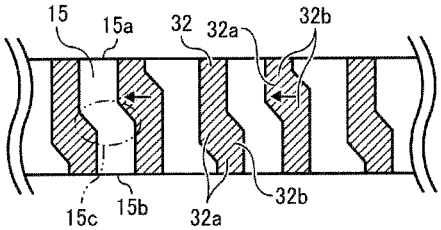
FIG. 8 is a vertical cross-sectional view illustrating an example of a configuration of a liquid ejection head according to a fourth illustrative embodiment.

A description is now given of a configuration of the liquid ejection head 100 according to a fourth illustrative embodiment, with reference to FIG. 8. FIG. 8 is a vertical cross-sectional view illustrating the first through-holes 15 and the partition walk 32 formed in the channel plate 2 of the liquid ejection head 100 according to the fourth illustrative embodiment.

In the fourth illustrative embodiment, in addition to dispose the thick portions 32*b* of the adjacent partition walls 32 alternately offset from each other as described in the third illustrative embodiment above, positions of the first through-holes 15 are shifted in the direction of the nozzle arrays. Specifically, comparing to the configuration illustrated in FIG. 7, the positions of the partition walls 32 are shifted leftward as indicated by arrows in FIG. 8 in the fourth illustrative embodiment so that the positions of the first through-holes 15 are slightly shifted in the direction of the nozzle arrays.

Accordingly, in addition to obtaining the effects obtained by the third illustrative embodiment, the slight shift in the positions of the first through-holes 15 in the direction of the nozzle arrays can equalize the fluid resistance in the first through-holes 15 adjacent to each other according to the fourth illustrative embodiment. Although convex and concave portions are provided at different positions in each of the first through-holes 15 adjacent to each other, because the fluid resistance is proportional to the fourth power of the radius of each of the first through-holes 15, fluid resistance, inertance, and capacitance of the fluid can be substantially equalized to prevent variation in ejection performance between the nozzles 11. In addition, in the fourth illustrative embodiment, the positions of the partition walls 32 are slightly shifted leftward in FIG. 8 for every other partition walls 32 in order to reduce a difference in a radius between the adjacent first through-holes 15. As a result, variation in ejection performance in each of the nozzles 11 can be further minimized compared to the third illustrative embodiment. Even if the ejection performance varies, change in a drive waveform for every other channel in the direction of the nozzle arrays can equalize the ejection performance.

Figure 9:
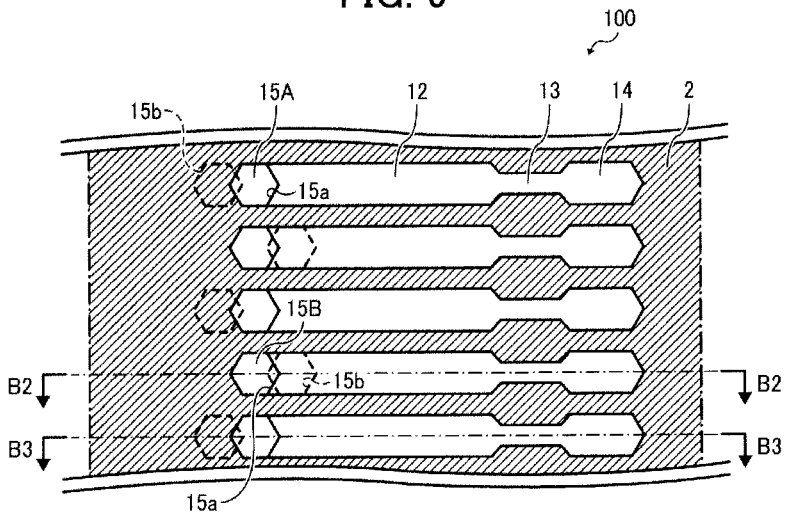
FIG. 9 is a horizontal cross-sectional view along a line A2-A2 in FIG. 10, illustrating an example of a configuration of a liquid ejection head according to a fifth illustrative embodiment.
Figure 10:
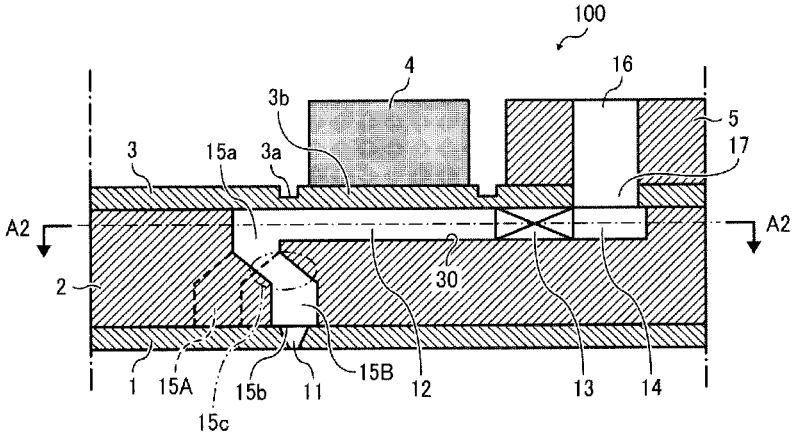
FIG. 10 is a vertical cross-sectional view along a line B2-B2 in FIG. 9.
Figure 11:
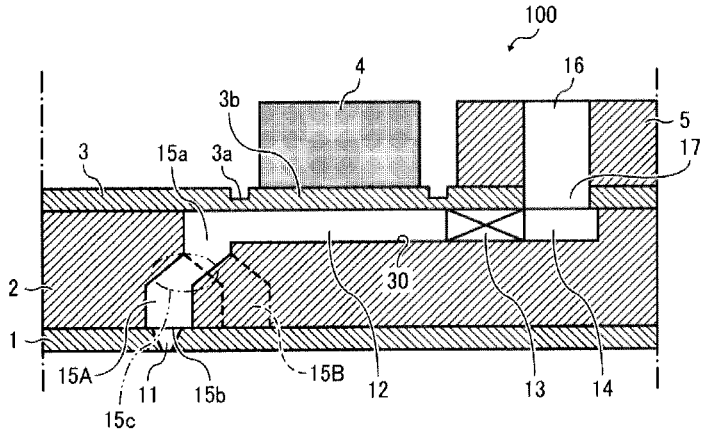
FIG. 11 is a vertical cross-sectional view along a line B3-B3 in FIG. 9.

A description is now given of a configuration of the liquid ejection head 100 according to a fifth illustrative embodiment, with reference to FIGS. 9 to 11. FIG. 9 is a horizontal cross-sectional view along a line A2-A2 in FIG. 10, illustrating a configuration of the liquid ejection head 100 according to the fifth illustrative embodiment. FIG. 10 is a vertical cross-sectional view along a line B2-B2 in FIG. 9. FIG. 11 is a vertical cross-sectional view along a line B3-B3 in FIG. 9.

In the fifth illustrative embodiment, the second openings 15*b* of the first through-holes 15 are offset from the first openings 15*a* alternately in opposite directions in a direction perpendicular to the direction of the nozzle arrays. In a similar manner to the foregoing illustrative embodiments, each of the first through-holes 15 has the bent portion 15*c* between the first and second openings 15*a* and 15*b*. In the fifth illustrative embodiment, the first through-holes 15 are bent at the bent portions 15*c*, respectively, in the direction perpendicular to the direction of the nozzle arrays.

Specifically, a first through-hole 15A of every other adjacent first through-holes 15 has the second opening 15*b* disposed offset from the first opening 15*a* in the same direction as the direction of flow of the liquid in the pressure chambers 12 in the direction perpendicular to the direction of the nozzle arrays. By contrast, a first through-hole 15B of the every other adjacent first through-holes 15 has the second opening 15*b* disposed offset from the opening 15*a* in a direction opposite the direction of flow of the liquid in the pressure chambers 12 in the direction perpendicular to the direction of the nozzle arrays.

In other words, the second openings 15*h* of the first through-holes 15A and 15B adjacent to each other are disposed offset from the first openings 15*a* in the opposite directions, respectively, in the direction perpendicular to the direction of the nozzle arrays.

Accordingly, the through-holes 15A and 15B adjacent to each other do not overlap in the direction of the nozzle arrays, so that no partition wall is present between the first through-holes 15A and 15B on the side facing the nozzle plates 1.

As a result, rigidity of the walls around the first through-holes 15 is increased, and pressure fluctuation in the first through-holes 15 do not adversely affect the adjacent first through-holes 15. Thus, variation in ejection performance between the adjacent nozzles 11 can be minimized and adjacent crosstalk can be reduced, thereby providing higher-quality images.

Even in a case in which the first through-holes 15A and 15B adjacent to each other partially overlap in the direction of the nozzle arrays due to a lack of an amount of bending at the bent portions 15*c* in the first through-holes 15A and 15B, a range in which the partition walls 32 are formed is reduced. As a result, rigidity of the partition walls 32 can be increased, thereby reducing adjacent channel crosstalk.

In addition, because the first through-holes 15A and 15B adjacent to each other are bent merely in the opposite directions, the volume and width of each of the channels from the pressure chambers 12 to the nozzles 11 via the first through-holes 15 in the direction perpendicular to the direction of flow of the liquid can be the same in the first through-holes 15A and 15B. As a result, speed of response to pressure fluctuation in the pressure chambers 12 can be substantially equalized between the adjacent channels.

Therefore, the actuators (i.e., the pressure generators) each pressurizing the adjacent pressure chambers 12 are driven with the same drive waveform so that liquid droplets are ejected from the nozzles 11 with the same ejection performance. Thus, variation in the ejection performance can be reduced without the actuators supplying different drive waveforms to each adjacent channels.

In addition, the nozzles 11 are also displaced corresponding to the first through-holes 15A and 15B adjacent to each other so that timing with which to drive the adjacent channels can be shifted. As a result, a difference in the ejection performance between simultaneous driving of the adjacent channels and driving of one of the adjacent channels can be further minimized.

Figure 12:
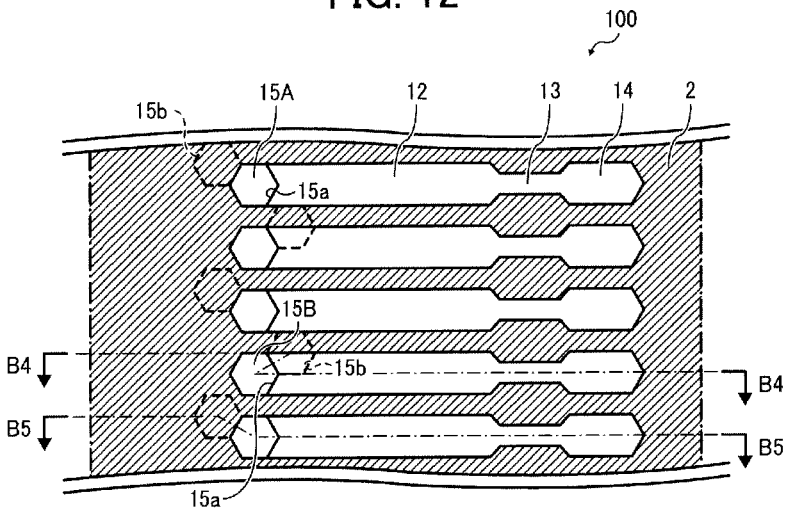
FIG. 12 is a horizontal cross-sectional view along a line A3-A3 in FIG. 13, illustrating an example of a configuration of a liquid ejection head according to a sixth illustrative embodiment.
Figure 13:
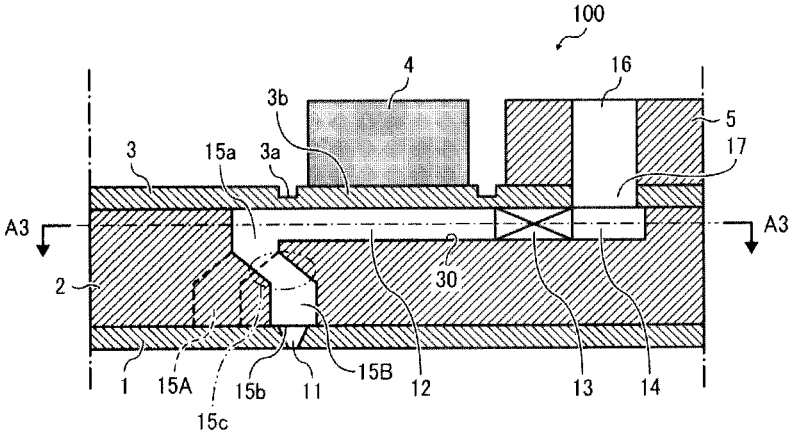
FIG. 13 is a vertical cross-sectional view along a line B4-B4 in FIG. 12.
Figure 14:
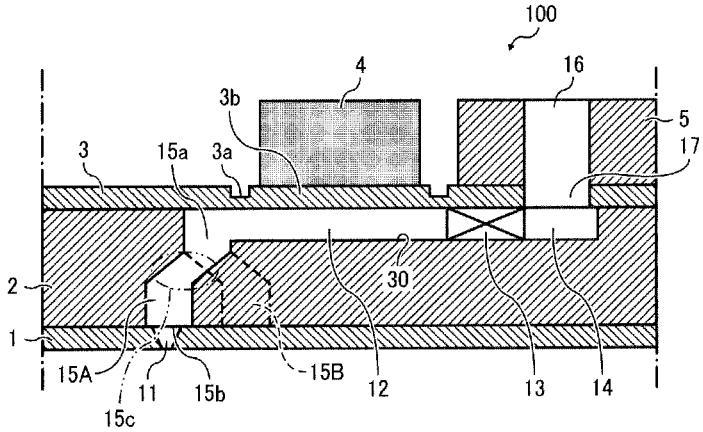
FIG. 14 is a vertical cross-sectional view along a line B5-B5 in FIG. 12.

A description is now given of a configuration of the liquid ejection head 100 according to a sixth illustrative embodiment, with reference to FIGS. 12 to 14. FIG. 12 is a horizontal cross-sectional view along a line A3-A3 in FIG. 13, illustrating a configuration of the liquid ejection head 100 according to the sixth illustrative embodiment. FIG. 13 is a vertical cross-sectional view along a line B4-B4 in FIG. 12. FIG. 14 is a vertical cross-sectional view along a line B5-B5 in FIG. 12.

In the sixth illustrative embodiment, the second openings 15*b* of the first through-holes 15 are offset from the first openings 15*a* alternately in both the direction of the nozzle arrays in a similar manner to the first illustrative embodiment and in the direction perpendicular to the direction of the nozzle arrays in a similar manner to the fifth illustrative embodiment. Thus, the first through-holes 15 are bent at the bent portions 15*c*, respectively, in both the direction of the nozzle arrays and the direction perpendicular to the direction of the nozzle arrays.

Accordingly, rigidity of both the partition walls 32 and the walls of the channels around the first through-holes 15 can be increased as previously described in the first and fifth illustrative embodiments, thereby further increasing the rigidity of the partition walls 32. As a result, adjacent channel crosstalk can be more reliably reduced, thereby providing higher-quality images.

Figure 15:
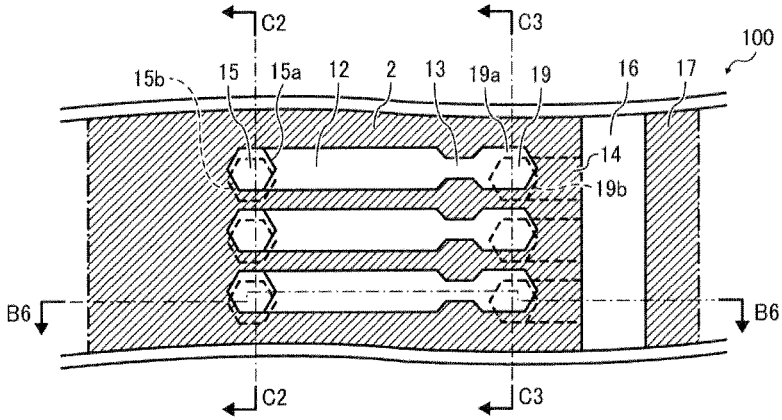
FIG. 15 is a horizontal cross-sectional view along a line A4-A4 in FIG. 17, illustrating an example of a configuration of a liquid ejection head according to a seventh illustrative embodiment.
Figure 16:
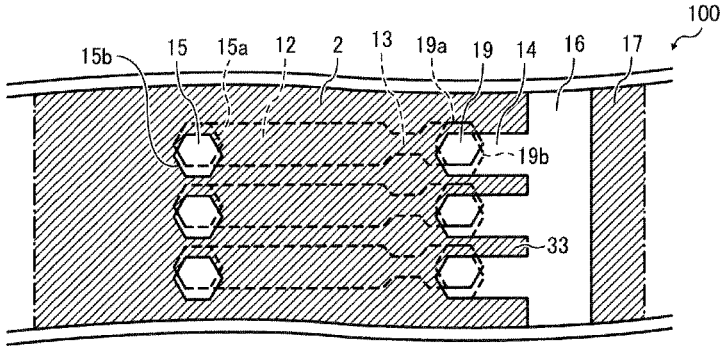
FIG. 16 is a horizontal cross-sectional view along a line A5-A5 in FIG. 17.
Figure 17:
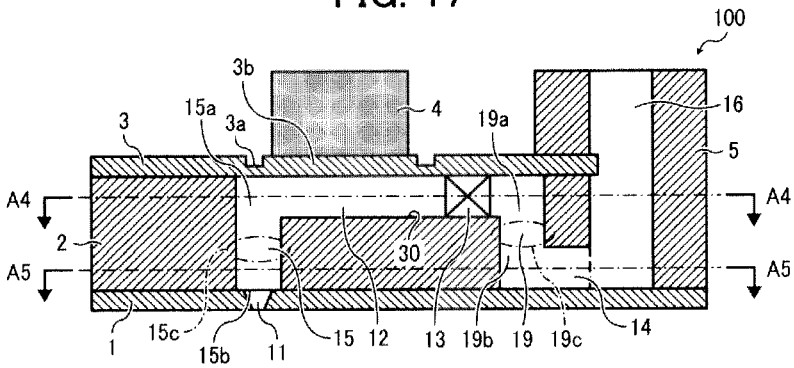
FIG. 17 is a vertical cross-sectional view along a line B6-B6 in FIG. 15.

A description is now given of a configuration of the liquid ejection head 100 according to a seventh illustrative embodiment, with reference to FIGS. 15 to 17. FIG. 15 is a horizontal cross-sectional view along a line A4-A4 in FIG. 17, illustrating a configuration of the liquid ejection head 100 according to the seventh illustrative embodiment. FIG. 16 is a horizontal cross-sectional view along a line A5-A5 in FIG. 17. FIG. 17 is a vertical cross-sectional view along a line B6-B6 in FIG. 15. It is to be noted that, although not actually shown in the cross-section along the line A5-A5 in FIG. 17, second openings 19*b* of second through-holes 19 disposed facing the nozzle plate 1 are indicated by broken lines in FIG. 15 for ease of illustration, and the identical indication is used for subsequent drawings.

In the seventh illustrative embodiment, the common liquid chamber member 5 is bonded to the nozzle plate 1 and the vibration plate 3 at different levels to form the common liquid chamber 16 outside the end of each of the channel plate 2 and the vibration plate 3 in the direction perpendicular to the direction of the nozzle arrays. The inlets 14 are formed at the end of the channel plate 2 on the side facing the nozzle plate 1 in the direction perpendicular to the direction of the nozzle arrays.

In the channel plate 2, the multiple second through-holes 19 that connect the inlets 14 and upstream portions of the fluid resistors 13, respectively, are formed throughout the thickness of the channel plate 2 with partition walls 33 interposed therebetween, respectively.

In the seventh illustrative embodiment, the second openings 15*b* of the first through-holes 15 are offset from the first openings 15*a* in the direction of the nozzle arrays in a similar manner to the first illustrative embodiment. In addition, each of the first through-holes 15 has the bent portion 15*c* between the first and second openings 15*a* and 15*b* so that the first through-holes 15 are bent at the bent portions 15*c*, respectively, in the direction of the nozzle arrays in a similar manner to the first to fourth illustrative embodiments. It is to be noted that the vertical cross-section along the line C2-C2 in FIG. 15 is the same as the vertical cross-section illustrated in FIG. 4 above, and the position of the bent portion 15*c* is encompassed by a broken-line circle in FIG. 17 for ease of explanation.

Each of the second through-holes 19 has a first opening 19*a* facing the vibration plate 3 and a second opening 19*b* facing the nozzle plate 1, and the second openings 19*b* are offset from the first openings 19*a* in the direction of the nozzle arrays. Each of the second through-holes 19 further has a bent portion 19*c* between the first and second openings 19*a* and 19*b* so that the second through-holes 19 are bent in the direction of the nozzle arrays in a similar manner to the first through-holes 15 according to the first to fourth illustrative embodiments. It is to be noted that the vertical cross-section along the line C3-C3 FIG. 15 is similar to the vertical cross-section illustrated in FIG. 4 above which shows the first through-holes 15 and the partition walls 32, and the position of the bent portion 19*c* is encompassed by a broken-line circle in FIG. 17 for ease of explanation.

The second openings 15*b* and 19*b* of the first and second through-holes 15 and 19 are offset from the first opening 15*a* and 19*a* in the same direction in the direction of the nozzle arrays, respectively. When viewed from the direction of flow of the liquid, the first and second through-holes 15 and 19 are bent at the bent portions 15*c* and 19*c* in the opposite directions.

As a result, rigidity of the partition walls 33 disposed in a supply side from which the liquid is supplied to the pressure chambers 12 can be increased, thereby reducing adjacent channel crosstalk also in the supply side.

Figure 18:
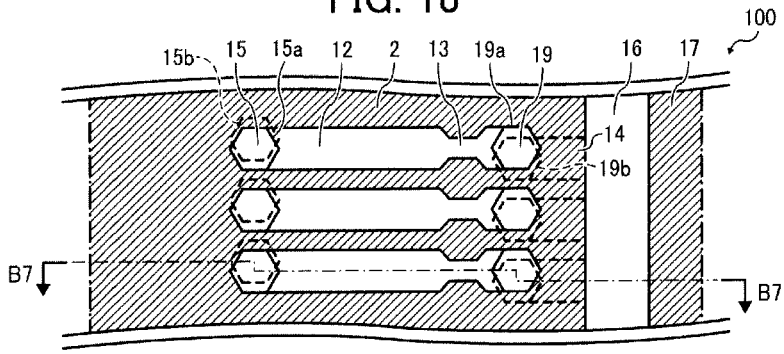
FIG. 18 is a horizontal cross-sectional view along a line A6-A6 in FIG. 20, illustrating an example of a configuration of a liquid ejection head according to an eighth illustrative embodiment.
Figure 19:
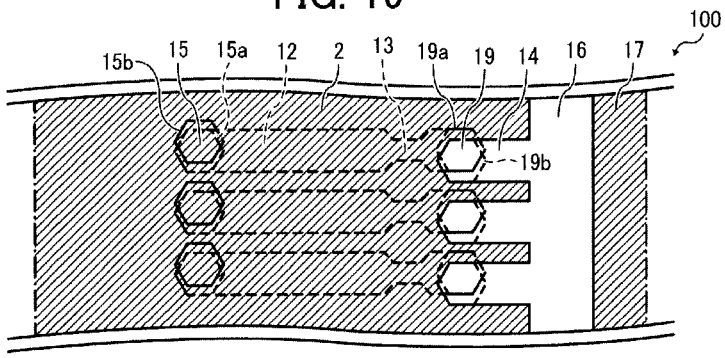
FIG. 19 is a horizontal cross-sectional view along a line A7-A7 in FIG. 20.
Figure 20:
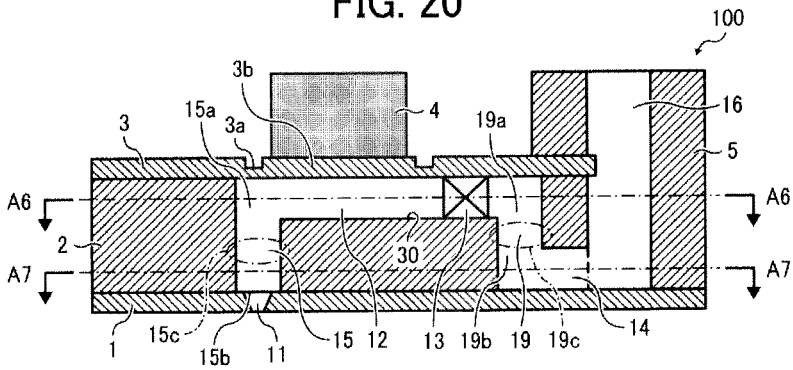
FIG. 20 is a vertical cross-sectional view along a line B7-B7 in FIG. 18.

A description is now given of a configuration of the liquid ejection head 100 according to an eighth illustrative embodiment, with reference to FIGS. 18 to 20. FIG. 18 is a horizontal cross-sectional view along a line A6-A6 in FIG. 20, illustrating a configuration of the liquid ejection head 100 according to the eighth illustrative embodiment. FIG. 19 is a horizontal cross-sectional view along a line A7-A7 in FIG. 20. FIG. 20 is a vertical cross-sectional view along a line B7-B7 in FIG. 18.

In the eighth illustrative embodiment, the second openings 15*b* and 19*b* of the first and second through-holes 15 and 19 are offset from the first opening 15*a* and 19*a* in opposite directions in the direction of the nozzle arrays. When viewed from the direction of flow of the liquid, the first and second through-holes 15 and 19 are bent at the bent portions 15*c* and 19*c* in the same direction. In other words, the two bent portions 15*c* and 19*c* are provided to each of the channels from the inlets 14 to the nozzles 11, respectively.

Accordingly, the nozzles 11 can be considerably offset from the inlets 14 in the direction of the nozzle arrays. In a case in which the liquid ejection head 100 has multiple nozzle arrays and the nozzles 11 of each of the multiple nozzle arrays are required to be disposed offset from each other corresponding to the resolution of the liquid ejection head 100, the two bent portions 15*c* and 19*c* can provide a desired amount of displacement between the nozzles 11 adjacent to each other when the desired amount of displacement cannot be achieved by the single bent portion.

Figure 21:
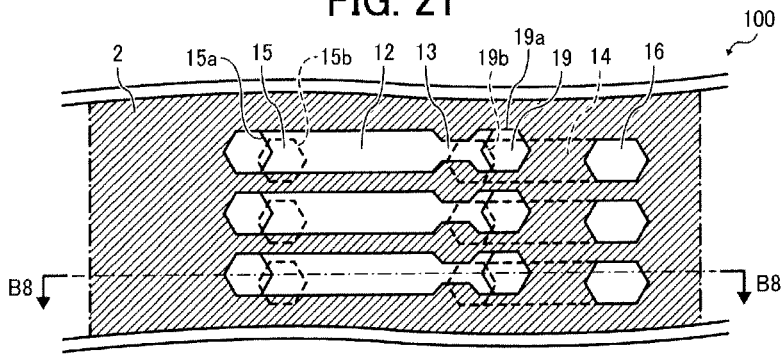
FIG. 21 is a horizontal cross-sectional view along a line A8-A8 in FIG. 23, illustrating an example of a configuration of a liquid ejection head according to a ninth illustrative embodiment.
Figure 22:
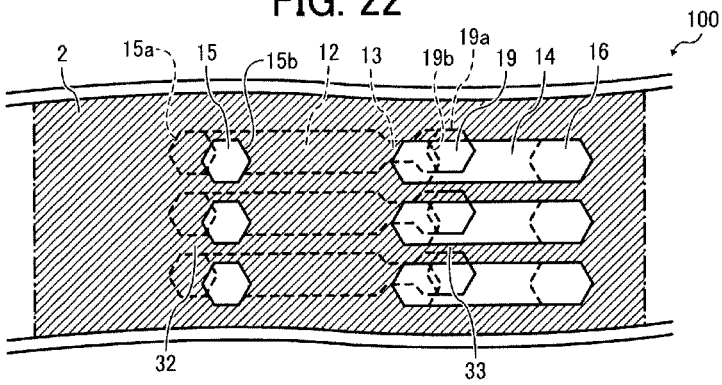
FIG. 22 is a horizontal cross-sectional view along a line A9-A9 in FIG. 23.
Figure 23:
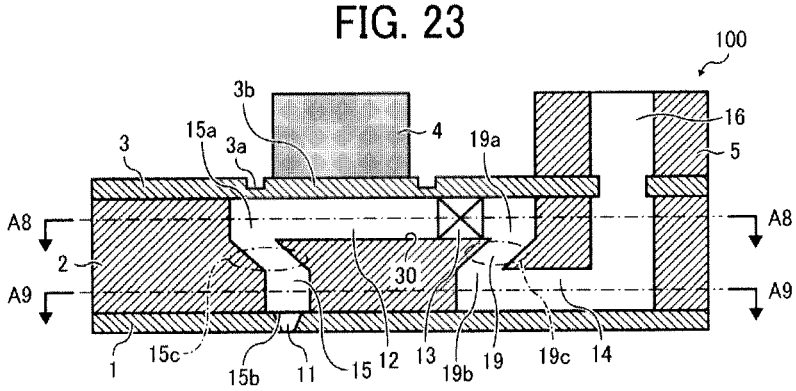
FIG. 23 is a vertical cross-sectional view along a line B8-B8 in FIG. 21.

A description is now given of a configuration of the liquid ejection head 100 according to a ninth illustrative embodiment, with reference to FIGS. 21 to 23. FIG. 21 is a horizontal cross-sectional view along a line A8-A8 in FIG. 23, illustrating a configuration of the liquid ejection head 100 according to the ninth illustrative embodiment. FIG. 22 is a horizontal cross-sectional view along a line A9-A9 in FIG. 23. FIG. 23 is a vertical cross-sectional view along a line B8-B8 in FIG. 21.

In the ninth illustrative embodiment, the second opening 15*b* of each of the first through-holes 15 is offset from the first opening 15*a* in both the direction of the nozzle arrays and the direction perpendicular to the direction of the nozzle arrays. Specifically, in the direction perpendicular to the direction of the nozzle arrays, the second opening 15*b* is offset from the first opening 15*a* in a direction opposite the direction of flow of the liquid in the pressure chambers 12.

In addition, the second opening 19*b* of the second through-holes 19 is offset from the first opening 19*a* also in both the direction of the nozzle arrays and the direction perpendicular to the direction of the nozzle arrays. Specifically, in the direction perpendicular to the direction of the nozzle arrays, the second opening 19*b* is offset from the first opening 19*a* in the same direction as the direction of flow of the liquid in the pressure chambers 12. In other words, the second openings 15*b* and 19*b* are offset from the first openings 15*a* and 19*a*, respectively, in the same direction in the direction of the nozzle arrays, and toward each other in the direction perpendicular to the direction of the nozzle arrays.

The above-described configuration can increase the rigidity of both the partition walls 32 and 33 and downsize the channels in the direction perpendicular to the direction of the nozzle arrays, thereby making the liquid ejection head 100 more compact.

Figure 24:
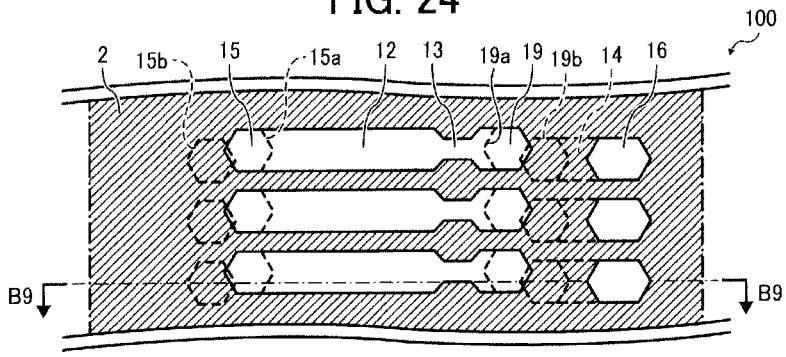
FIG. 24 is a horizontal cross-sectional view along a line A10-A10 in FIG. 26, illustrating an example of a configuration of a liquid ejection head according to a tenth illustrative embodiment.
Figure 25:
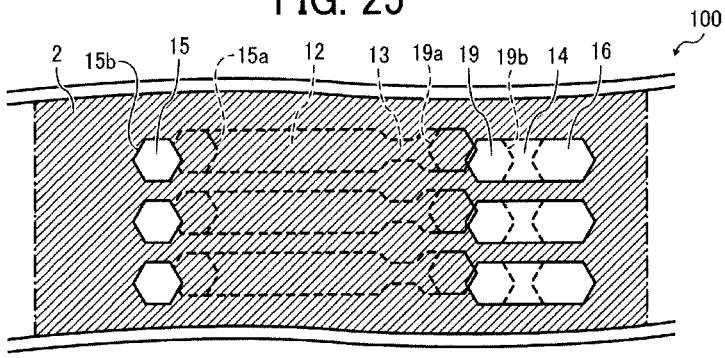
FIG. 25 is a horizontal cross-sectional view along a line A11-A11 in FIG. 26.
Figure 26:
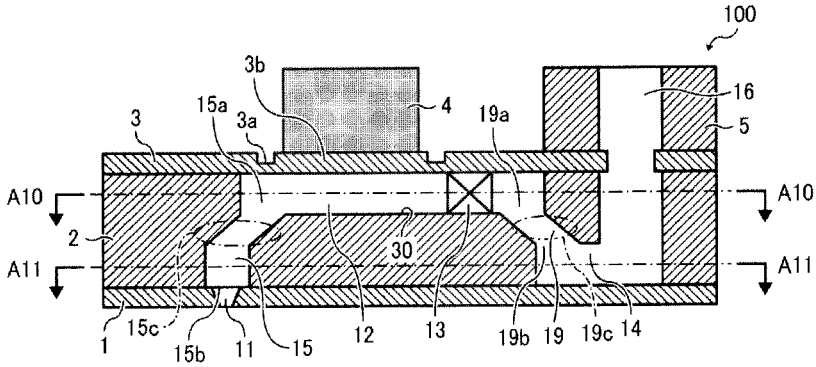
FIG. 26 is a vertical cross-sectional view along a line B9-B9 in FIG. 24.

A description is now given of a configuration of the liquid ejection head 100 according to a tenth illustrative embodiment, with reference to FIGS. 24 to 26. FIG. 24 is a horizontal cross-sectional view along a line A10-A10 in FIG. 26, illustrating a configuration of the liquid ejection head 100 according to the tenth illustrative embodiment. FIG. 25 is a horizontal cross-sectional view along a line A11-A11 in FIG. 26. FIG. 26 is a vertical cross-sectional view along a line B9-B9 in FIG. 24.

In the tenth illustrative embodiment, the second opening 15*b* of each of the first through-holes 15 is offset from the first opening 15*a* in both the direction of the nozzle arrays and the direction perpendicular to the direction of the nozzle arrays. Specifically, in the direction perpendicular to the direction of the nozzle arrays, the second opening 15*b* is offset from the first opening 15*a* in the same direction as the direction of flow of the liquid in the pressure chambers 12.

In addition, the second opening 19*b* of each of the second through-holes 19 is offset from the first opening 19*a* in both the direction of the nozzle arrays and the direction perpendicular to the direction of the nozzle arrays. Specifically, in the direction perpendicular to the direction of the nozzle arrays, the second opening 19*b* is offset from the first opening 19*a* in the direction opposite the direction of flow of the liquid in the pressure chambers 12. In other words, the second openings 15*b* and 19*b* are offset from the first openings 15*a* and 19*a*, respectively, in the same direction in the direction of the nozzle arrays, and away from each other in the direction perpendicular to the direction of the nozzle arrays.

Each of the first and second through-holes 15 and 19 is bent in the direction away from the pressure chambers 12, respectively, so that grooves and holes that reduce the rigidity of the channel plate 2 can be disposed in wider ranges in the channel plate 2. As a result, the grooves and the holes that cause reduction in the rigidity of the channel plate 2 are prevented from densely packed in one portion of the channel plate 2, thereby securing the rigidity of the channel plate 2 entirely.

Figure 27:
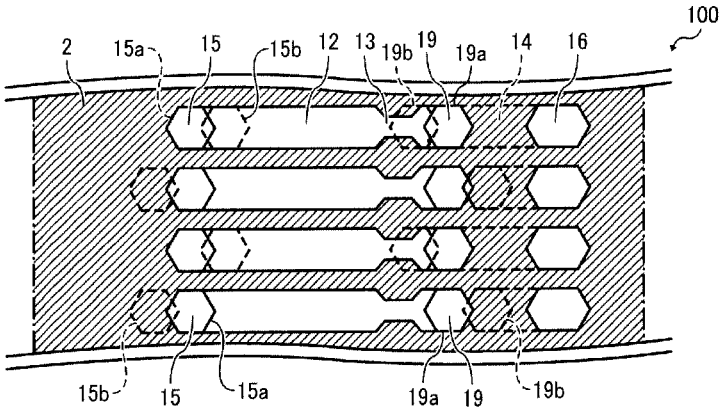
FIG. 27 is a horizontal cross-sectional view along a line A12-A12 in FIG. 29, illustrating an example of a configuration of a liquid ejection head according to an eleventh illustrative embodiment.
Figure 28:
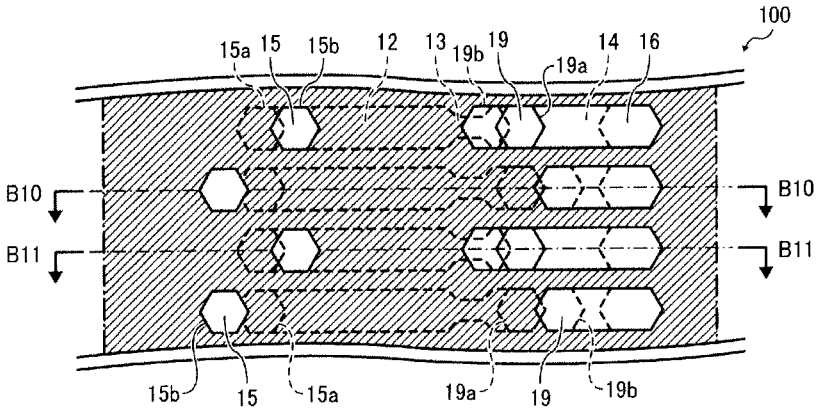
FIG. 28 is a horizontal cross-sectional view along a line A13-A13 in FIG. 29.
Figure 29:
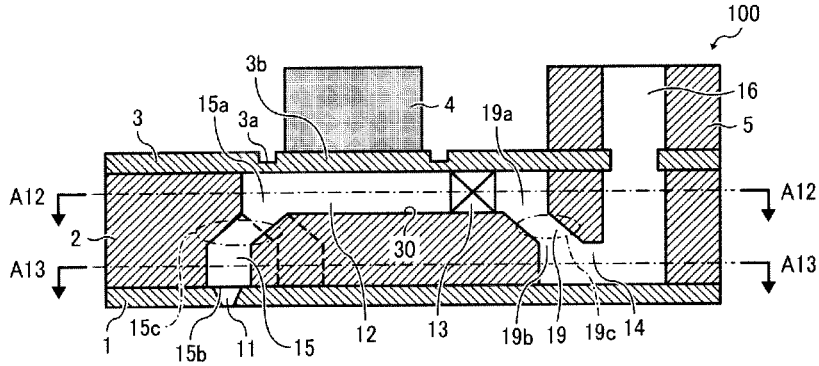
FIG. 29 is a vertical cross-sectional view along a line B10-B10 in FIG. 28.
Figure 30:
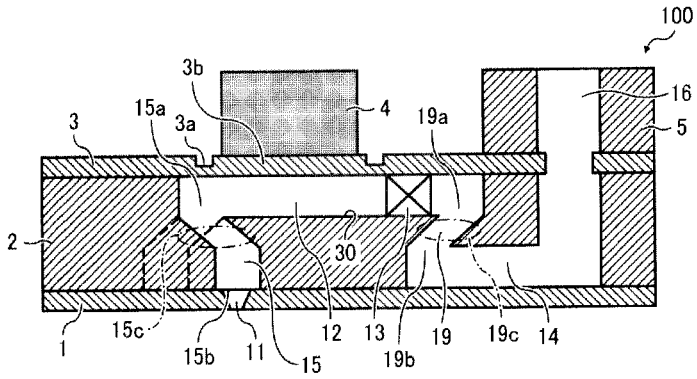
FIG. 30 is a vertical cross-sectional view along a line B11-B11 in FIG. 28.

A description is now given of a configuration of the liquid ejection head 100 according to an eleventh illustrative embodiment, with reference to FIGS. 27 to 30. FIG. 27 is a horizontal cross-sectional view along a line A12-A12 in FIG. 29, illustrating a configuration of the liquid ejection head 100 according to the eleventh illustrative embodiment. FIG. 28 is a horizontal cross-sectional view along a line A13-A13 in FIG. 29. FIG. 29 is a vertical cross-sectional view along a line B10-B10 in FIG. 28. FIG. 30 is a vertical cross-sectional view along a line B11-B11 in FIG. 28.

In the eleventh illustrative embodiment, one of the two adjacent first through-holes 15 or second through-holes 19 is bent at the bent portion 15*c* or 19*c* in the direction in which the second openings 15*b* and 19*b* approach each other in the direction perpendicular to the direction of the nozzle arrays in a similar manner to the ninth illustrative embodiment, and the other one of the two adjacent first through-holes 15 or second through-holes 19 is bent at the bent portion 15*c* or 19*c* in the direction in which the second openings 15*h* and 19*b* are away from each other in the direction perpendicular to the direction of the nozzle arrays in a similar manner to the tenth illustrative embodiment.

Accordingly, in each of the pressure chambers 12, the second openings 15*b* and 19*b* of the first and second through-holes 15 and 19 are offset from the first openings 15*a* and 19*a* in the opposite directions in the direction perpendicular to the direction of the nozzle arrays. As a result, the first through-holes 15 adjacent to each other do not overlap in the direction of the nozzle arrays in a similar manner to the fifth illustrative embodiment, so that no partition wall is present between the first through-holes 15 adjacent to each other on the side facing the nozzle plate 1. Similarly, the second through-holes 19 adjacent to each other do not overlap in the direction of the nozzle arrays, so that no partition wall is present between the second through-holes 19 adjacent to each other on the side facing the nozzle plate 1.

As a result, rigidity of the walls around the first and second through-holes 15 and 19 is increased, and pressure fluctuation in the first and second through-holes 15 and 19 do not adversely affect the adjacent first and second through-holes 15 and 19, respectively. Thus, adjacent channel crosstalk can be reduced, thereby providing higher-quality images.

Even in a case in which the first or second through-holes 15 or 19 adjacent to each other partially overlap in the direction if the nozzle arrays due to a lack of an amount of bending in the bent portions 15*c* or 19*c* in the first through-holes 15 or 19, a range in which the partition walls 32 or 33 are formed is reduced in the above-described configuration according to the eleventh illustrative embodiment. As a result, rigidity of the walls around the first and second through-holes 15 and 19 can be increased, thereby reducing adjacent channel crosstalk.

Figure 31:
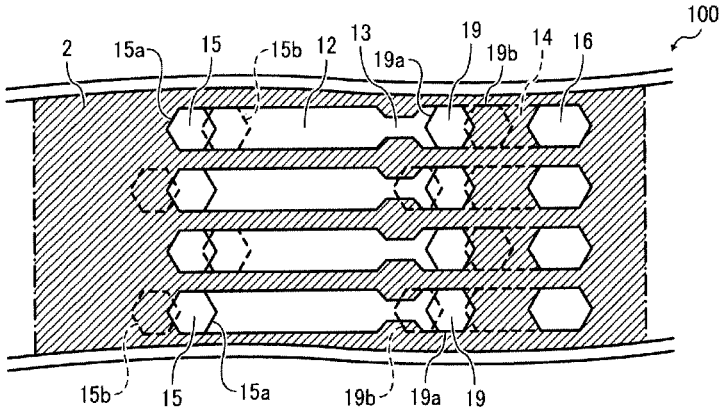
FIG. 31 is a horizontal cross-sectional view along a line A14-A14 in FIG. 33, illustrating an example of a configuration of a liquid ejection head according to a twelfth illustrative embodiment.
Figure 32:
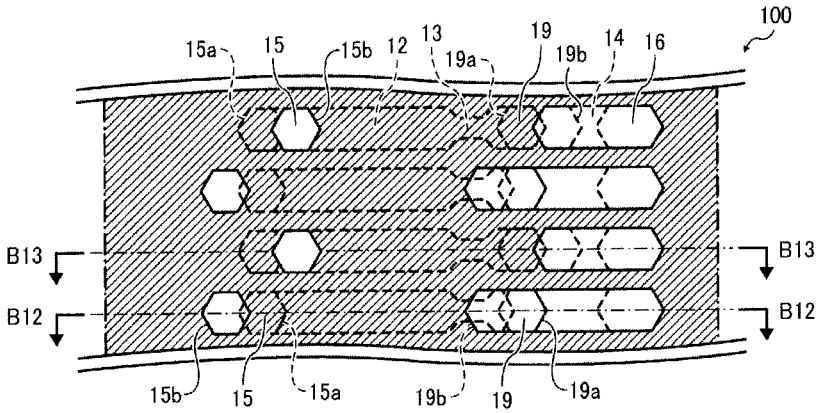
FIG. 32 is a horizontal cross-sectional view along a line A15-A15 in FIG. 33.
Figure 33:
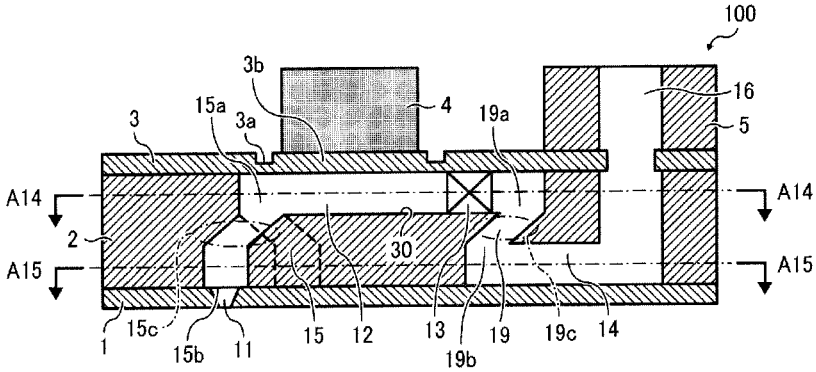
FIG. 33 is a vertical cross-sectional view along a line B12-B12 in FIG. 32.
Figure 34:
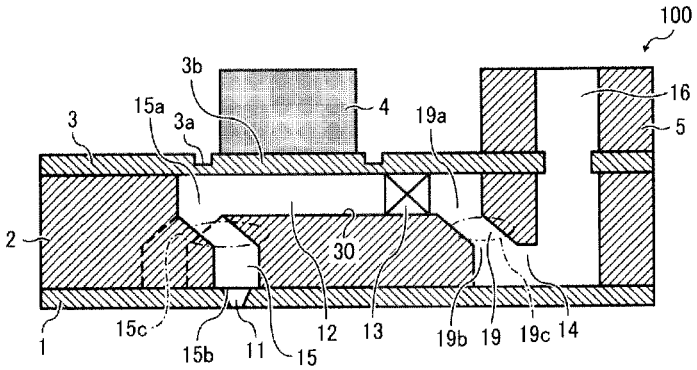
FIG. 34 is a vertical cross-sectional view along a line B13-B13 in FIG. 32.

A description is now given of an example of a configuration the liquid ejection head 100 according to a twelfth illustrative embodiment, with reference to FIGS. 31 to 34. FIG. 31 is a horizontal cross-sectional view along a line A14-A14 in FIG. 33, illustrating a configuration of the liquid ejection head 100 according to the twelfth illustrative embodiment. FIG. 32 is a horizontal cross-sectional view along a line A15-A15 in FIG. 33. FIG. 33 is a vertical cross-sectional view along a line B12-B12 in FIG. 32. FIG. 34 is a vertical cross-sectional view along a line B13-B13 in FIG. 32.

In the twelfth illustrative embodiment, one of two adjacent first or second through-holes 15 or 19 has the second opening 15*b* or 19*b* disposed offset from the first opening 15*a* or 19*a* in the same direction as the direction of flow of the liquid in the pressure chambers 12 in the direction perpendicular to the direction of the nozzle arrays. In addition, the other one of two adjacent first or second through-holes 15 or 19 has the second opening 15*b* or 19*b* disposed offset from the first opening 15*a* or 19*a* in the direction opposite the direction of flow of the liquid in the pressure chambers 12 in the direction perpendicular to the direction of the nozzle arrays. Accordingly, in each of the pressure chambers 12, the second openings 15*b* and 19*b* of the first and second through-holes 15 and 19 are offset from the first openings 15*a* and 19*a* in the same direction in the direction perpendicular to the direction of the nozzle arrays.

However, the second openings 15*b* and 19*b* of the first and second through-holes 15 and 19 are not offset from the first openings 15*a* and 19*a*, respectively, in the direction of the nozzle arrays. As a result, the first through-holes 15 adjacent to each other partially overlap in the direction of the nozzle arrays on the side facing the vibration plate 3 so that the partition walls 32 are formed between the first through-holes 15 adjacent to each other on the side facing the vibration plate 3. By contrast, no partition wall is present between the first through-holes 15 adjacent to each other on the side facing the nozzle plate 1. Similarly, the second through-holes 19 adjacent to each other partially overlap in the direction of the nozzle arrays on the side facing the vibration plate 3 so that the partition walls 33 are formed between the second through-holes 19 adjacent to each other on the side facing the vibration plate 3. By contrast, no partition wall is present between the second through-holes 19 adjacent to each other on the side facing the nozzle plate 1.

Therefore, rigidity of the walls around the first and second through-holes 15 and 19 is increased, and pressure fluctuation in the first and second through-holes 15 and 19 do not adversely affect the adjacent first and second through-holes 15 and 19, respectively. Thus, adjacent channel crosstalk can be reduced, thereby providing higher-quality images.

Even in a case in which the first or second through-holes 15 or 19 adjacent to each other partially overlap in the direction of the nozzle arrays due to a lack of an amount of bending at the bent portions 15*c* or 19*c* in the first through-holes 15 or 19, a range in which the partition walls 32 or 33 are formed is reduced in the above-described configuration according to the twelfth illustrative embodiment. As a result, rigidity of the walls around the first and second through-holes 15 and 19 can be increased, thereby reducing adjacent channel crosstalk.

In the twelfth illustrative embodiment, each of the adjacent channels from the inlets 14 to the nozzles 11 has a different volume as illustrated in FIGS. 33 and 34. However, a volume of the channel after the fluid resistor 13 or a volume and diameter of the channel after the individual channel constructed of the inlet 14, the fluid resistor 13, the pressure chamber 12, and the through-holes 15 and 19 contributes to speed of response to pressure fluctuation. In the liquid ejection head 100 according to the twelfth illustrative embodiment, each of the adjacent channels has substantially the same volume and diameter from the fluid resistor 13 to the nozzle 11.

Therefore, the adjacent channels have substantially the same speed of response to the pressure fluctuation, and no drive unit or drive waveform dedicated to each channel is needed. In a case in which the liquid ejection head 100 needs to perform more accurate image formation, the channels are configured to have the same shape from the inlets 14 to the second through-holes 19, respectively, in a similar manner to the seventh and eighth illustrative embodiments described previously. As a result, each of the channels has the same speed of response to the pressure fluctuation.

Figure 35:
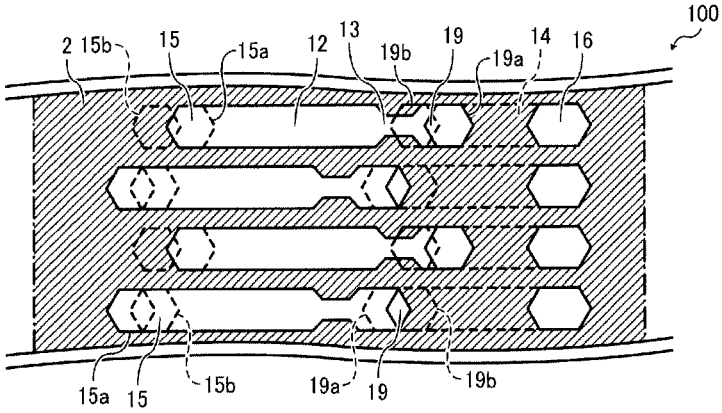
FIG. 35 is a horizontal cross-sectional view along a line A16-A16 in FIG. 37, illustrating an example of a configuration of a liquid ejection head according to a thirteenth illustrative embodiment.
Figure 36:
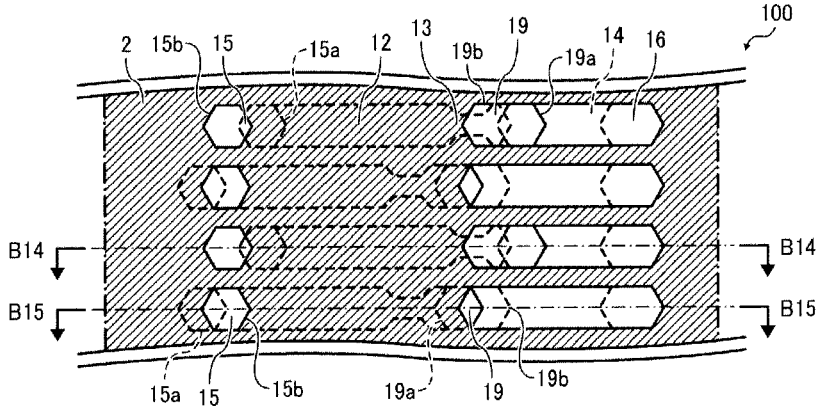
FIG. 36 is a horizontal cross-sectional view along a line A17-A17 in FIG. 37.
Figure 37:
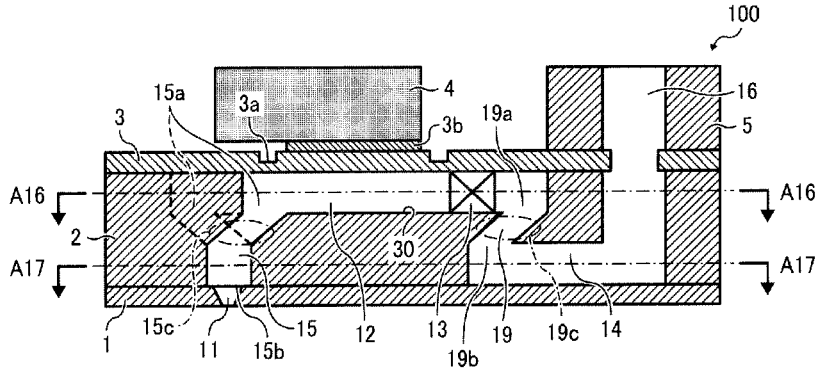
FIG. 37 is a vertical cross-sectional view along a line B14-B14 in FIG. 36.
Figure 38:
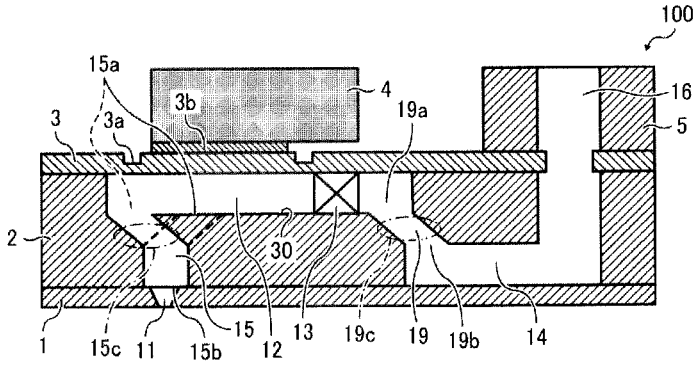
FIG. 38 is a vertical cross-sectional view along a line B15-B15 in FIG. 36.

A description is now given of an example of a configuration of the liquid ejection head 100 according to a thirteenth illustrative embodiment, with reference to FIGS. 35 to 38. FIG. 35 is a horizontal cross-sectional view along a line A16-A16 in FIG. 37, illustrating a configuration of the liquid ejection head 100 according to the thirteenth illustrative embodiment. FIG. 36 is a horizontal cross-sectional view along a line A17-A17 in FIG. 37. FIG. 37 is a vertical cross-sectional view along a line B14-B14 in FIG. 36. FIG. 38 is a vertical cross-sectional view along a line B15-B15 in FIG. 36.

In the thirteenth illustrative embodiment, a portion from the fluid resistor 13 to the pressure chamber 12 is offset in every other adjacent channel in the direction perpendicular to the direction of the nozzle arrays. As a result, each of the channels has the same volume and diameter from the inlets 14 to the fluid resistors 13, respectively. Therefore, the same liquid ejection performance can be provided by supplying the same drive waveform, and a control unit to supply a different drive waveform to each of the adjacent channels is not needed.

Figure 39:
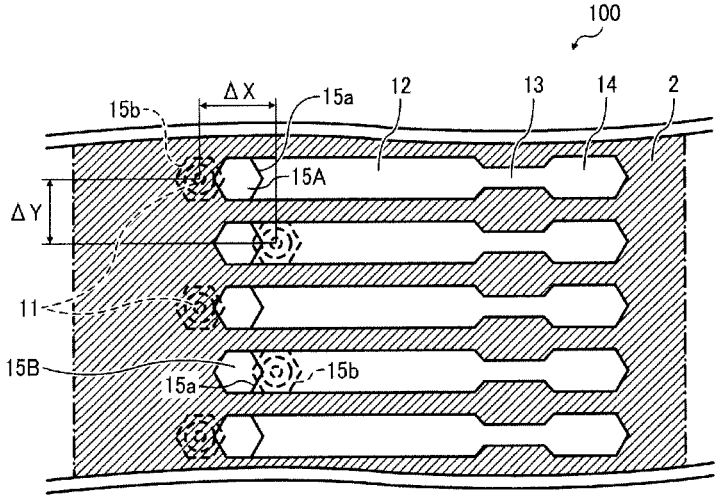
FIG. 39 is a horizontal cross-sectional view illustrating an example of a configuration liquid ejection head according to a fourteenth illustrative embodiment.

A description is now given of a configuration of the liquid ejection head 100 according to a fourteenth illustrative embodiment, with reference to FIG. 39. FIG. 39 is a horizontal cross-sectional view illustrating an example of a configuration of the liquid ejection head 100 according to the fourteenth illustrative embodiment.

In a similar mariner to the fifth illustrative embodiment described previously, the first through-holes 15A and 15B adjacent to each other have the second openings 15*b* disposed offset from the first opening 15*a* in the opposite directions in the direction perpendicular to the direction of the nozzle arrays, respectively, according to the fourteenth illustrative embodiment.

A distance between the second openings 15*b* of the two adjacent nozzles 11 in the direction perpendicular to the direction of the nozzle arrays, that is, an amount of bending $\Delta X$ which is the sum of amounts of bending at the bent portions 15*c* of each of the first through-holes 15A and 15B with the openings 15*a* as a reference, is an integral multiple of a nozzle pitch $\Delta Y$, that is, a distance between the two adjacent nozzles 11 in the direction of the nozzle arrays, or l/n of the nozzle pitch $\Delta Y$ (n is an integer).

Liquid ejection timing input into the liquid ejection head 100 is often controlled to eject liquid droplets onto the recording medium at a timing interval in which the liquid ejection head 100 is moved by the nozzle pitch $\Delta Y$ at a relative speed of the liquid ejection head 100 and the recording medium such that the liquid droplets are ejected onto the recording medium in a matrix pattern. At this time, the amount of bending $\Delta X$ is set to an integral multiple of the nozzle pitch $\Delta Y$ or l/n of the nozzle pitch $\Delta Y$ so that the liquid droplets are ejected at control timings with frequency different by integral multiple. As a result, the liquid droplets are ejected onto the recording medium in a matrix pattern, and therefore provision of a control unit having a different phase of ejection timing is not needed.

Figure 40:
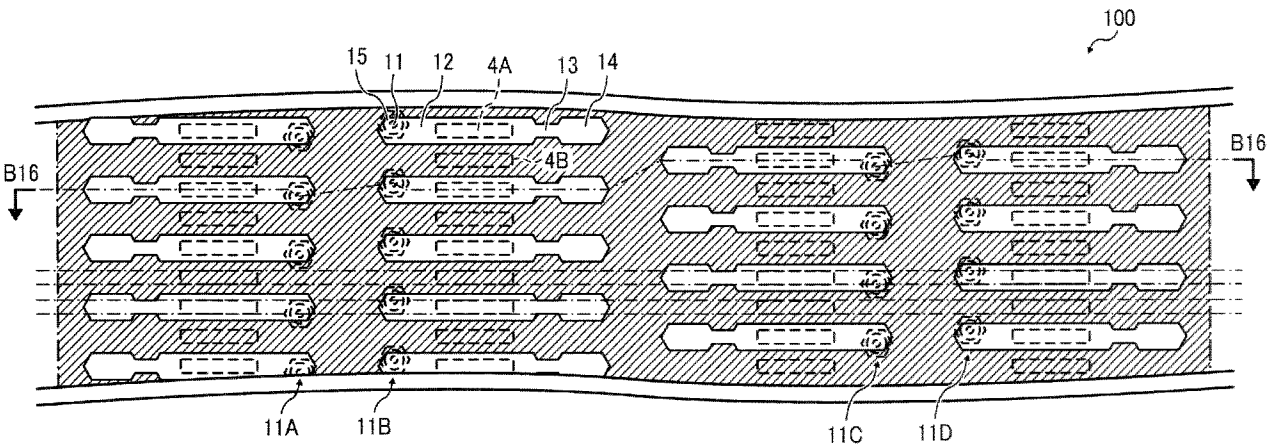
FIG. 40 is a horizontal cross-sectional view along a line A18-A18 in FIG. 41, illustrating an example of a configuration of a liquid ejection head according to a fifteenth illustrative embodiment.
Figure 41:
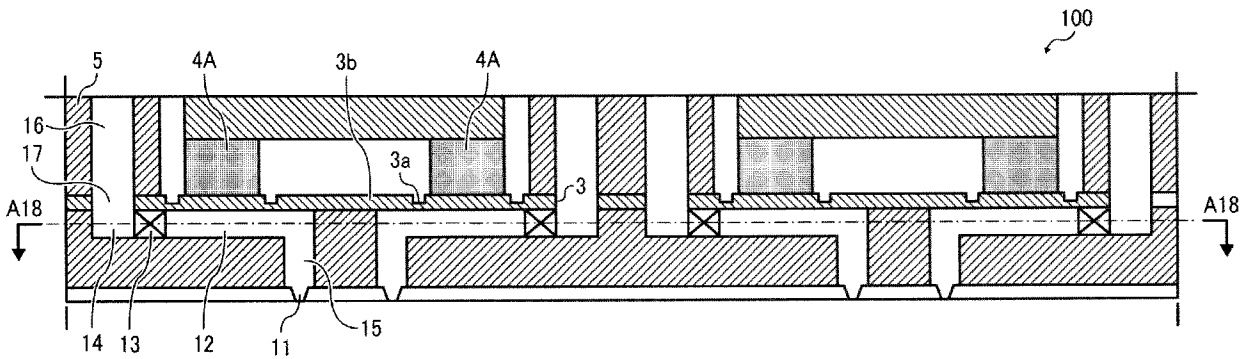
FIG. 41 is a vertical cross-sectional view along a line B16-B16 in FIG. 40.

A description is now given of a configuration of the liquid ejection head 100 according to a fifteenth illustrative embodiment, with reference to FIGS. 40 and 41. FIG. 40 is a horizontal cross-sectional view along a line A18-A18 in FIG. 41, illustrating an example of a configuration of the liquid ejection head 100 according to the fifteenth illustrative embodiment. FIG. 41 is a vertical cross-sectional view along a line B16-B16 in FIG. 40.

The liquid ejection head 100 according to the fifteenth illustrative embodiment has first to fourth nozzle arrays 11A to 11D, each constructed of the multiple nozzles 11. The piezoelectric member 4 has columnar piezoelectric elements provided corresponding to the pressure chambers 12, which, in the present illustrative embodiment, are drive columns 4A, and columns provided between the adjacent pressure chambers 12, which, in the present illustrative embodiment, are non-drive columns 4B. The drive columns 4A and the non-drive columns 4B are provided alternately in the direction of the nozzle arrays 11A to 11D, respectively.

In a case in which the four piezoelectric members 4 provided corresponding to the nozzle arrays 11A to 11D, respectively, are produced by separation by dicing or the like, the four piezoelectric members 4 or the two piezoelectric members 4 fixed to the same base are separated from one another only at the same position and pitch in the direction of the nozzle arrays. Therefore, when the piezoelectric members 4 are divided one by one by dicing at a pitch of 300 dpi, the drive columns 4A are disposed at a half of the pitch of division, that is, 150 dpi. In another approach, when the drive columns 4A of the two piezoelectric members 4 are disposed in a zigzag pattern, they are disposed at a pitch twice as much as 150 dpi, that is, 300 dpi.

In the fifteenth illustrative embodiment, the first through-holes 15 are bent such that the second openings 15*b* of the first through-holes 15 are offset by a quarter of the pitch (150 dpi) of the drive columns 4A in the direction of the nozzle arrays in each of the nozzle arrays 11A to 11D. Thus, the nozzles 11 of each of the four nozzle arrays 11A to 11D are offset from one another by ¼ pitch in the direction of the nozzle arrays by bending the first through-holes 15, respectively. The recording medium is moved relative to the liquid ejection head 100 in the direction perpendicular to the direction of the nozzle arrays so that the liquid ejection head 100 having the four nozzle arrays 11A to 11D can form an image on the recording medium with a resolution of 600 dpi, which is four times the nozzle pitch of the single nozzle array.

Figure 42:
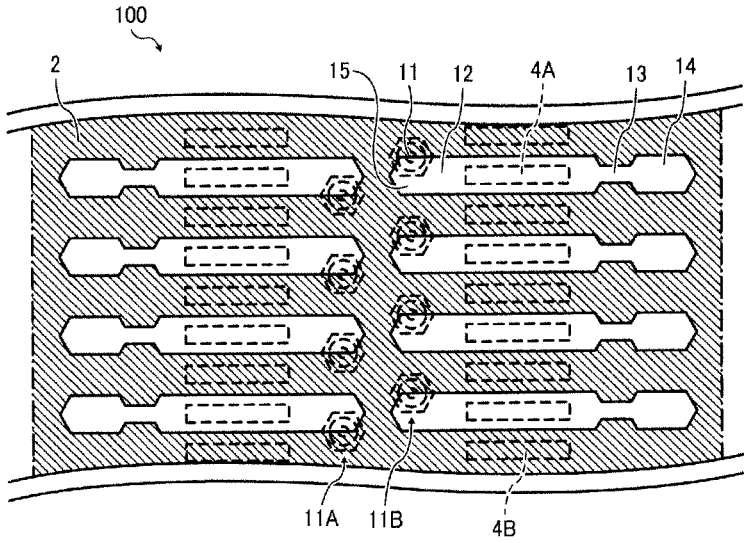
FIG. 42 is a horizontal cross-sectional view along a line A19-A19 in FIG. 43, illustrating an example of a configuration of a liquid ejection head according to a sixteenth illustrative embodiment.
Figure 43:
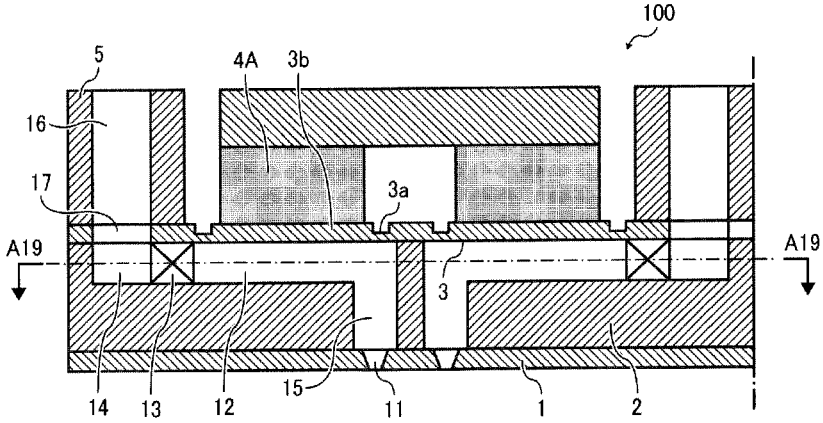
FIG. 43 is a vertical cross-sectional view along a direction perpendicular to a direction of nozzle arrays, illustrating the liquid ejection head according to the sixteenth illustrative embodiment.

A description is now given of a configuration of the liquid ejection head 100 according to a sixteenth illustrative embodiment, with reference to FIGS. 42 and 43. FIG. 42 is a horizontal cross-sectional view along a line A19-A19 in FIG. 43, illustrating the liquid ejection head 100 according to the sixteenth illustrative embodiment. FIG. 43 is a vertical cross-sectional view along the direction perpendicular to the direction of the nozzle arrays, illustrating the liquid ejection head 100 according to the sixteenth illustrative embodiment.

In the sixteenth illustrative embodiment, the liquid ejection head 100 has two nozzle arrays 11A and 11B each constructed of the multiple nozzles 11. The pressure chambers 12 of each of the nozzle arrays 11A and 11B are provided at the same position in the direction perpendicular to the direction of the nozzle arrays, respectively.

The first through-holes 15 of each of the nozzle arrays 11A and 11B are bent by a quarter of the nozzle pitch in the opposite directions, respectively, in the direction of the nozzle arrays. Accordingly, the nozzles 11 of each of the nozzle arrays 11A and 11B are offset by a quarter of the nozzle pitch from the pressure chambers 12, respectively.

In the above-described configuration, a shape of the pressure chamber 12, the fluid resistor 13, the inlet 14, the piezoelectric member 4, and the common liquid chamber member 5 for each channel in the nozzle array 11A is symmetrical to a shape of the pressure chamber 12, the fluid resistor 13, the inlet 14, the piezoelectric member 4, and the common liquid chamber member 5 for each channel in the nozzle array 11B, thereby simplifying the configuration. In such a case, the liquid ejection head 100 having the two nozzle arrays 11A and 11B can form an image with a resolution twice the pitch of the pressure chambers 12.

Figure 44:
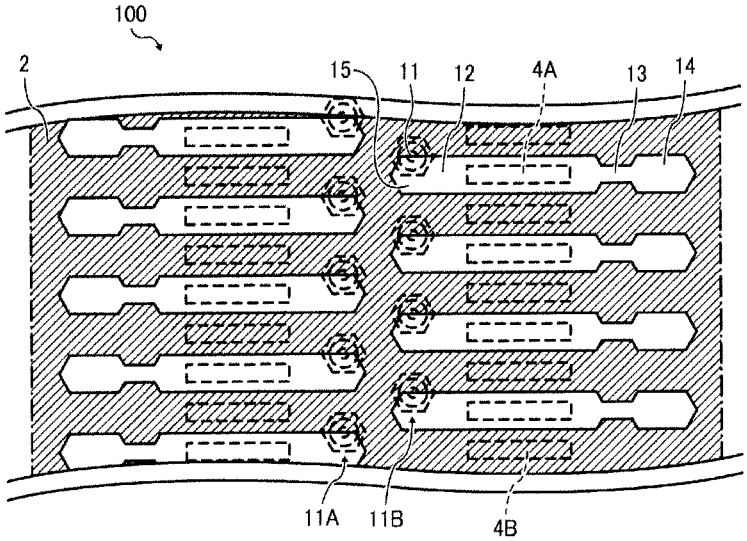
FIG. 44 is a horizontal cross-sectional view along a line A20-A20 in FIG. 45, illustrating an example of a configuration of a liquid ejection head according to a seventeenth illustrative embodiment.
Figure 45:
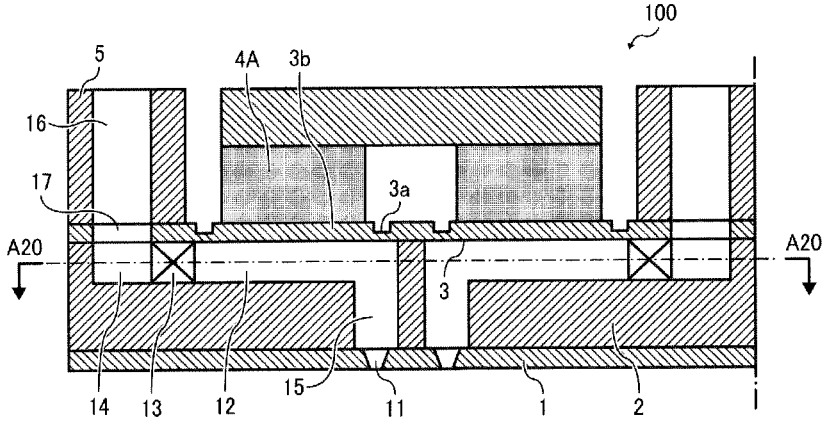
FIG. 45 is a vertical cross-sectional view along the direction perpendicular to the direction of the nozzle arrays, illustrating the liquid ejection head according to the seventeenth illustrative embodiment.

A description is now given of a configuration of the liquid ejection head 100 according to a seventeenth illustrative embodiment, with reference to FIGS. 44 and 45. FIG. 44 is a horizontal cross-sectional view along a line A20-A20 in FIG. 45, illustrating the liquid ejection head 100 according to the seventeenth illustrative embodiment. FIG. 45 is a vertical cross-sectional view along the direction perpendicular to the direction of the nozzle arrays, illustrating the liquid ejection head 100 according to the seventeenth illustrative embodiment.

In the seventeenth illustrative embodiment, the liquid ejection head 100 has the two nozzle arrays 11A and 11B each constructed of the multiple nozzles 11. The pressure chambers 12 of the nozzle arrays 11A and 11B are provided in a zigzag pattern in the direction of the nozzle arrays. The first through-holes 15 of each of the nozzle arrays HA and 11B are bent in the same direction in the direction of the nozzle arrays such that the nozzles 11 of each of the nozzle arrays 11A and 11B are offset from the pressure chambers 12 by the same amount in the same direction in the direction of the nozzle arrays, respectively.

With such a configuration, the liquid ejection head 100 having the two nozzle arrays 11A and 11B can form an image with a resolution twice the pitch of the pressure chambers 12. In such a case, even when the first through-holes 15 are bent by an amount which is not related to the pitch of the pressure chambers 12, the nozzles 11 of each of the nozzle arrays 11A and 11B are disposed at a pitch twice as much as the pitch of the pressure chambers 12.

A large amount of bending in the first through-holes 15 increases a geometrical moment of inertia, thereby improving rigidity. Thus, an amount of bending can be set such that the necessary rigidity is secured, thereby increasing degree of freedom in design and configuration of the liquid ejection head 100.

Figure 46:
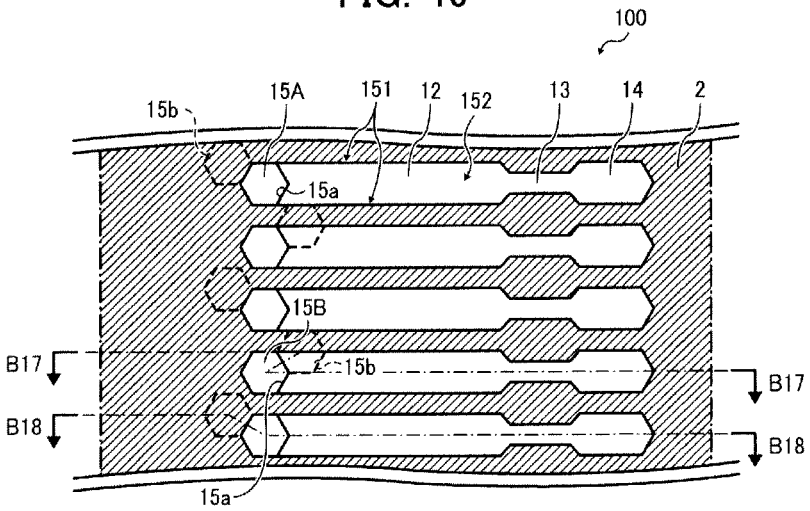
FIG. 46 is a horizontal cross-sectional view along a line A21-A21 in FIG. 47, illustrating an example of a configuration of a liquid ejection head according to an eighteenth illustrative embodiment.
Figure 47:
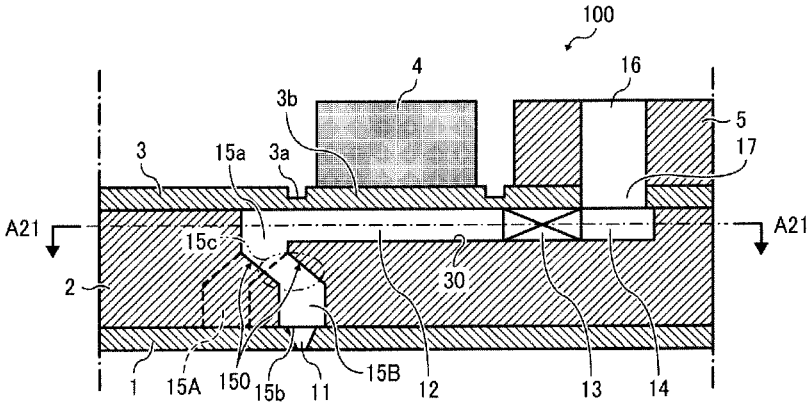
FIG. 47 is a vertical cross-sectional view along a line B17-B17 in FIG. 46.
Figure 48:
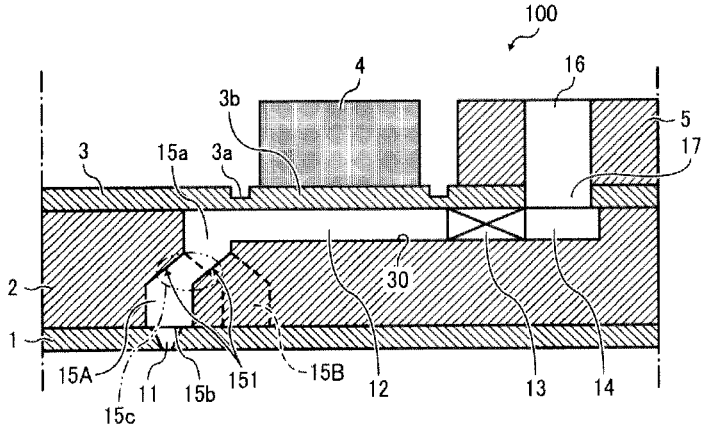
FIG. 48 is a vertical cross-sectional view along a line B18-B18 in FIG. 46.

A description is now given of a configuration of the liquid ejection head 100 according to an eighteenth illustrative embodiment, with reference to FIGS. 46 to 48. FIG. 46 is a horizontal cross-sectional view along a line A21-A21 in FIG. 47, illustrating an example of a configuration of the liquid ejection head 100 according to the eighteenth illustrative embodiment. FIG. 47 is a vertical cross-sectional view along a line B17-B17 in FIG. 46. FIG. 48 is a vertical cross-sectional view along a line B18-B18 in FIG. 46.

In the eighteenth illustrative embodiment, the channel plate 2 is formed of a crystalline silicon substrate, and each of the first through-holes 15A and 15B is bent at the bent portions 15*c* in both the direction of the nozzle arrays and the direction perpendicular to the direction of the nozzle arrays so that bent faces 150 and 151 have crystal orientation <111> or <100>.

In anisotropic etching of the crystalline silicon substrate, speed of etching of crystal faces <100>, <110>, and <111> is slower and more stable than speed of etching of higher crystal faces. In addition, speed of etching of the crystal face <111> is considerably slower than the speed of etching of other crystal faces.

For these reasons, when the channel plate 2 is formed of a silicon substrate with crystal orientation <110>, the bent faces 151 having crystal orientation <111> are hardly etched while faces 152 having crystal orientation <110> is etched in a direction away from the plane of FIG. 46, thereby easily forming vertical partition walls.

The bent faces 150 and 151 respectively formed in the bent portions 15*c* of the first through-holes 15A and 15B have the crystal face <100> or <111>, thereby accurately forming the walls of the bent portions 15*c*.

Figure 49:
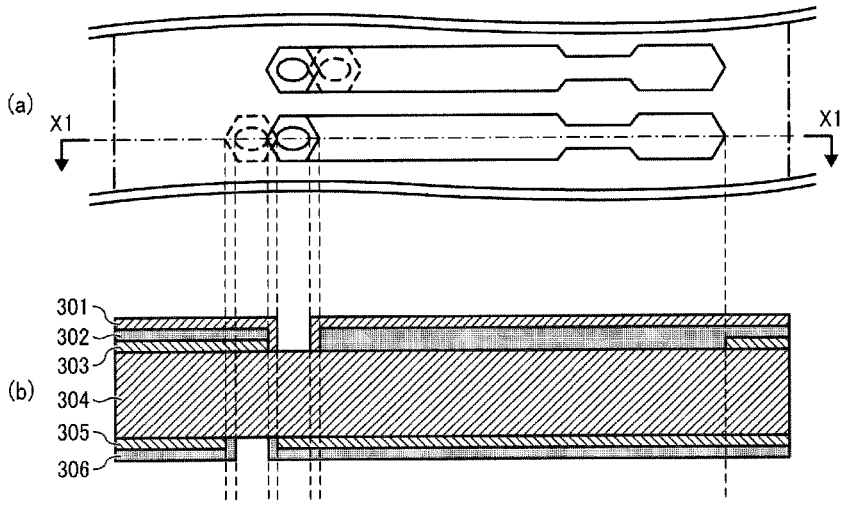
FIG. 49(*a*) is a plan view illustrating an example of manufacture of a channel plate of the liquid ejection head according to illustrative embodiments.
Figure 50:
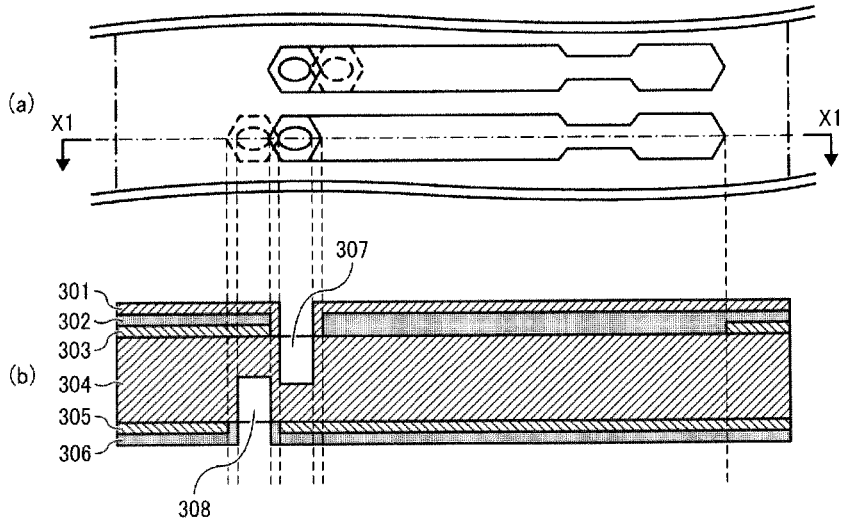
FIG. 50(*a*) is a plan view illustrating the manufacture of the channel plate after the process illustrated in FIGS. 49(*a*) and 49(*b*)
Figure 51:
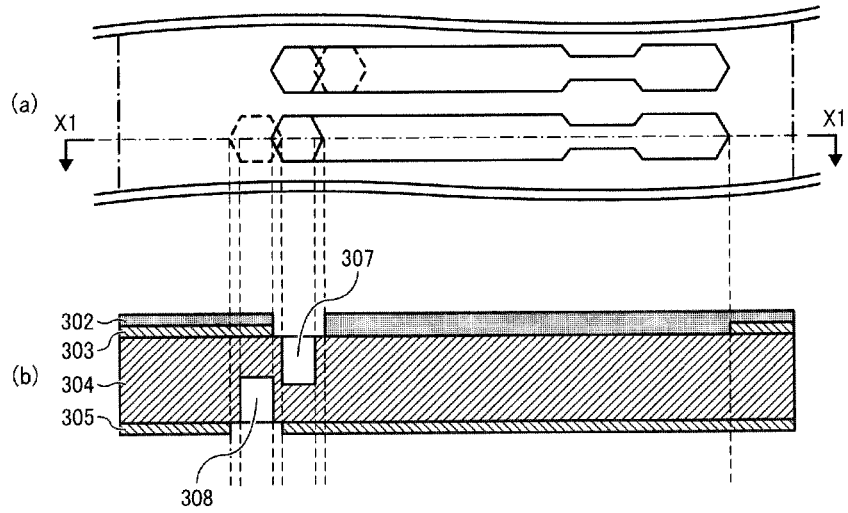
FIG. 51(*a*) is a plan view illustrating the manufacture of the channel plate after the process illustrated in FIGS. 50(*a*) and 50(*b*)
Figure 52:
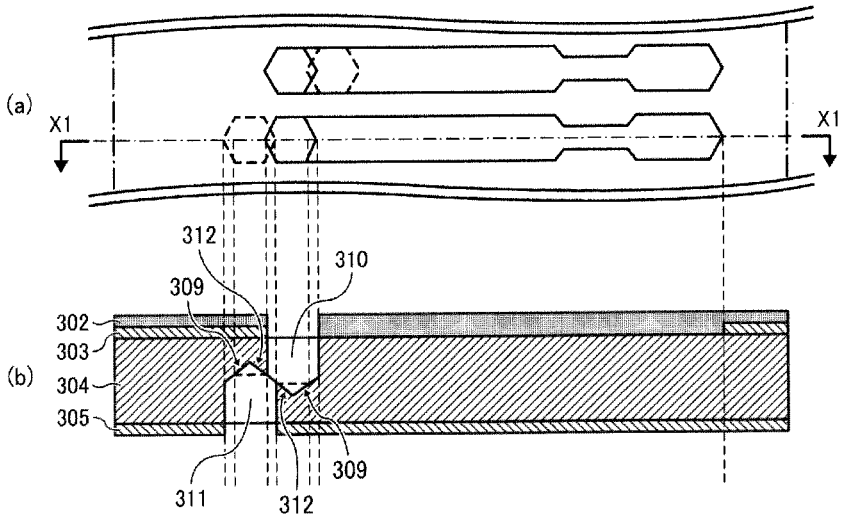
FIG. 52(*a*) is a plan view illustrating the manufacture of the channel plate after the process illustrated in FIGS. 51(*a*) and 51(*b*)
Figure 53:
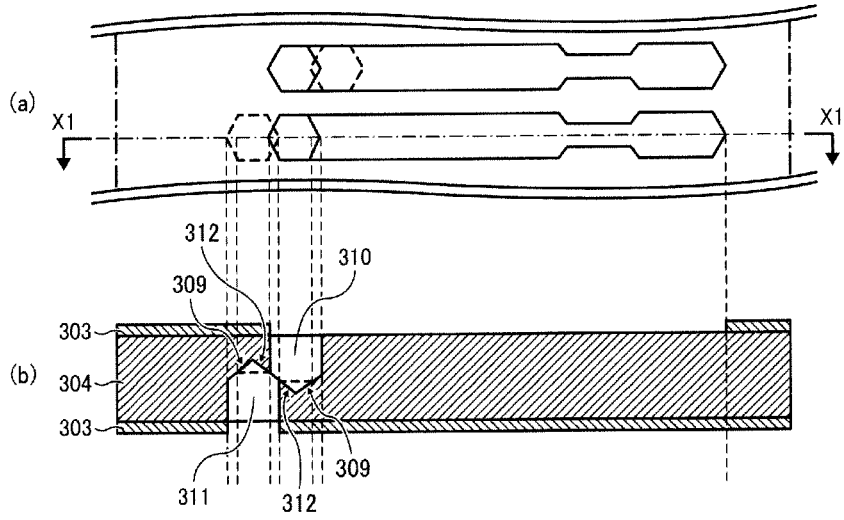
FIG. 53(*a*) is a plan view illustrating the manufacture of the channel plate after the process illustrated in FIGS. 52(*a*) and 52(*b*)
Figure 54:
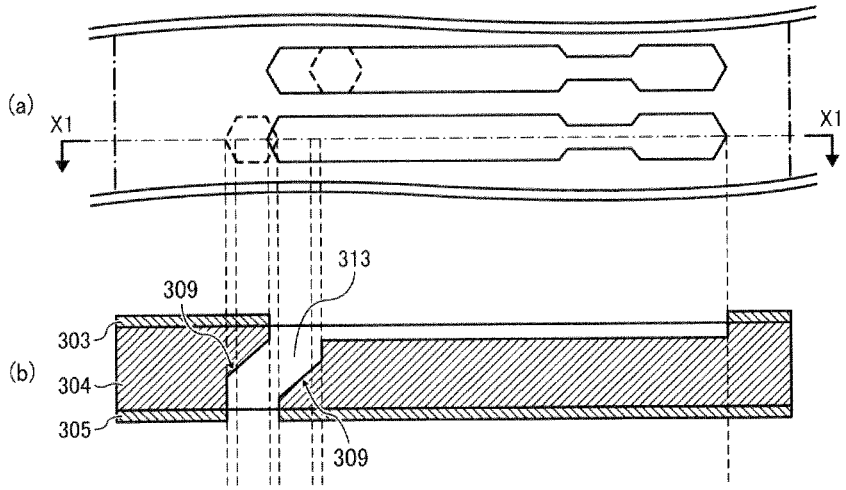
FIG. 54(*a*) is a plan view illustrating the manufacture of the channel plate after the process illustrated in FIGS. 53(*a*) and 53(*b*)
Figure 55:
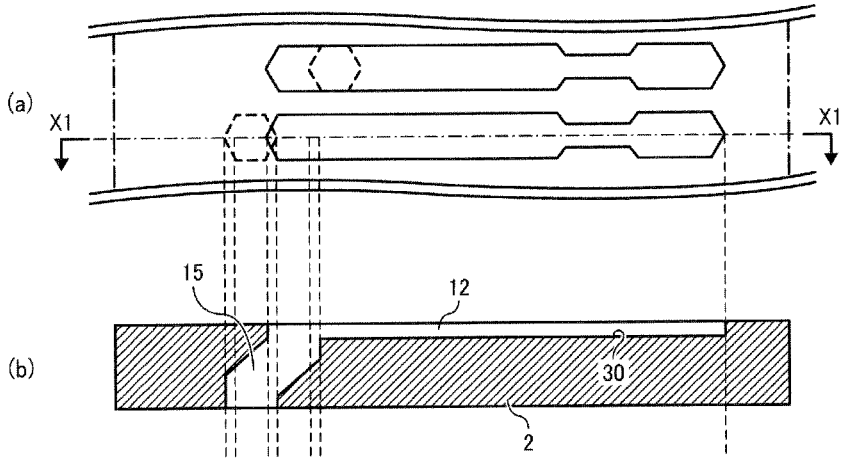
FIG. 55(*a*) is a plan view illustrating the manufacture of the channel plate after the process illustrated in FIGS. 54(*a*) and 54(*b*)

A description is now given of an example of a process of manufacturing the channel plate 2, with reference to FIGS. 49 to 55. FIG. 49(*a*) is a plan view illustrating an example of manufacture of the channel plate 2. FIG. 49(*b*) is a vertical cross-sectional view along a line X1-X1 in FIG. 49(*a*). FIG. 50(*a*) is a plan view illustrating the manufacture of the channel plate 2 after the process illustrated in FIGS. 49(*a*) and 49(*b*). FIG. 50(*b*) is a vertical cross-sectional view along a line X1-X1 in FIG. 50(*a*). FIG. 51(*a*) is a plan view illustrating the manufacture of the channel plate 2 after the process illustrated in FIGS. 50(*a*) and 50(*b*). FIG. 51(*b*) is a vertical cross-sectional view along a line X1-X1 in FIG. 51(*a*). FIG. 52(*a*) is a plan view illustrating the manufacture of the channel plate 2 after the process illustrated in FIGS. 51(*a*) and 51(*b*). FIG. 52(*b*) is a vertical cross-sectional view along a line X1-X1 in FIG. 52(*a*). FIG. 53(*a*) is a plan view illustrating the manufacture of the channel plate 2 after the process illustrated in FIGS. 52(*a*) and 52(*b*). FIG. 53(*b*) is a vertical cross-sectional view along a line X1-X1 in FIG. 53(*a*). FIG. 54(*a*) is a plan view illustrating the manufacture of the channel plate 2 after the process illustrated in FIGS. 53(*a*) and 53(*b*). FIG. 54(*h*) is a vertical cross-sectional view along a line X1-X1 in FIG. 54(*a*), FIG. 55(*a*) is a plan view illustrating the manufacture of the channel plate 2 after the process illustrated in FIGS. 54(*a*) and 54(*b*). FIG. 55(*b*) is a vertical cross-sectional view taken along a line X1-X1 in FIG. 55(*a*).

First, as illustrated in FIGS. 49(*a*) and 49(*h*), a silicon substrate 304 with crystal orientation <110> is provided with a pattern 301 for dry-etching a top surface thereof, a pattern 302 for wet-etching the top surface, a pattern 303 for wet-etching the top surface, a pattern 305 for wet-etching a bottom surface thereof, and a pattern 306 for dry-etching the bottom surface. Each of the patterns 301 to 303, 305, and 306 may be formed of an oxidized $SiO_2$ film, a polysilicon film, or an SiN film, or may be formed of a combination of resists with different chemical resistance.

Next, substantially vertical holes 307 and 308 are formed in the silicon substrate 304 by dry-etching from the top and bottom surfaces, respectively, as illustrated in FIGS. 50(*a*) and 50(*b*). For example, during dry-etching, etching and deposition are repeatedly performed by Bosch method using an ICP etching device, which is one type of dry-etching method, to form the substantially vertical holes 307 and 308 in the silicon substrate 304.

Subsequently, the pattern 301 for dry-etching the top surface and the pattern 306 for dry-etching the bottom surface are exfoliated as illustrated in FIGS. 51(*a*) and 51(*b*). Thereafter, anisotropic etching is performed on the holes 307 and 308 so that first and second holes 310 and 311 are formed in the silicon substrate 304 as illustrated in FIGS. 52(*a*) and 52(*b*). Examples of etchant used for anisotropic etching include, but are not limited to, KOH and TMAH. Anisotropic etching mainly etches faces with crystal orientation having a faster etching rate so that faces 309 with crystal orientation having a slower etching rate are etched from dry-etched corners in a direction of thickness of the silicon substrate 304 as illustrated in FIGS. 52(*a*) and 52(*b*).

When the first and second holes 310 and 311 are not connected to each other at this stage, they are soon surrounded by faces having a slower etching rate and the base of each of the first and second holes 310 and 311 is shaped like a pyramid.

A width or depth of dry-etching is adjusted so that the first and second holes 310 and 311 are connected to each other by wet-etching. As a result, faces having a faster etching rate are formed at a portion which the first and second holes 310 and 311 are connected to each other. Thus, etching proceeds from the faces having a faster etching rate so that protrusions 312 are formed at the portions in which the first and second holes 310 and 311 are connected to each other as illustrated in FIGS. 52(*a*) and 52(*b*).

At this time, the pattern 302 for wet-etching the top surface is exfoliated at a certain timing as illustrated in FIGS. 53(*a*) and 53(*b*) to perform anisotropic etching. As a result, the first and second holes 310 and 311 are connected to each other to form a single hole 313 as illustrated in FIGS. 54(*a*) and 54(*b*), and the grooves 30 are formed in the silicon substrate 304 that constitutes the channel plate 2 while the protrusions 312 are etched.

Finally, the patterns 303 and 305 for wet-etching are exfoliated to provide the channel plate 2 in which the first through-holes 15 each constructed of the bent hole 313 and the pressure chambers 12 and so forth constructed of the grooves 30 are formed as illustrated in FIGS. 55(*a*) and 55(*b*).

An example of the crystal face having a slower etching rate used for anisotropic etching includes, but is not limited to, a crystalline silicon substrate with crystal orientation <111>. An example of the crystal face having a faster etching rate includes, but is not limited to, a crystalline silicon substrate with crystal orientation <110> or <100>.

Although the first through-holes 15 are bent in the direction perpendicular to the direction of the nozzle arrays in the above-described example, the process of manufacturing described above can be used when the first through-holes 15 are bent in the direction of the nozzle arrays or both the direction of the nozzle arrays and the direction perpendicular to the direction of the nozzle arrays.

It is to be noted that the liquid ejection head 100 may be formed together with a tank that supplies the liquid to the liquid ejection head 100 as a single integrated cartridge.

Figure 56:
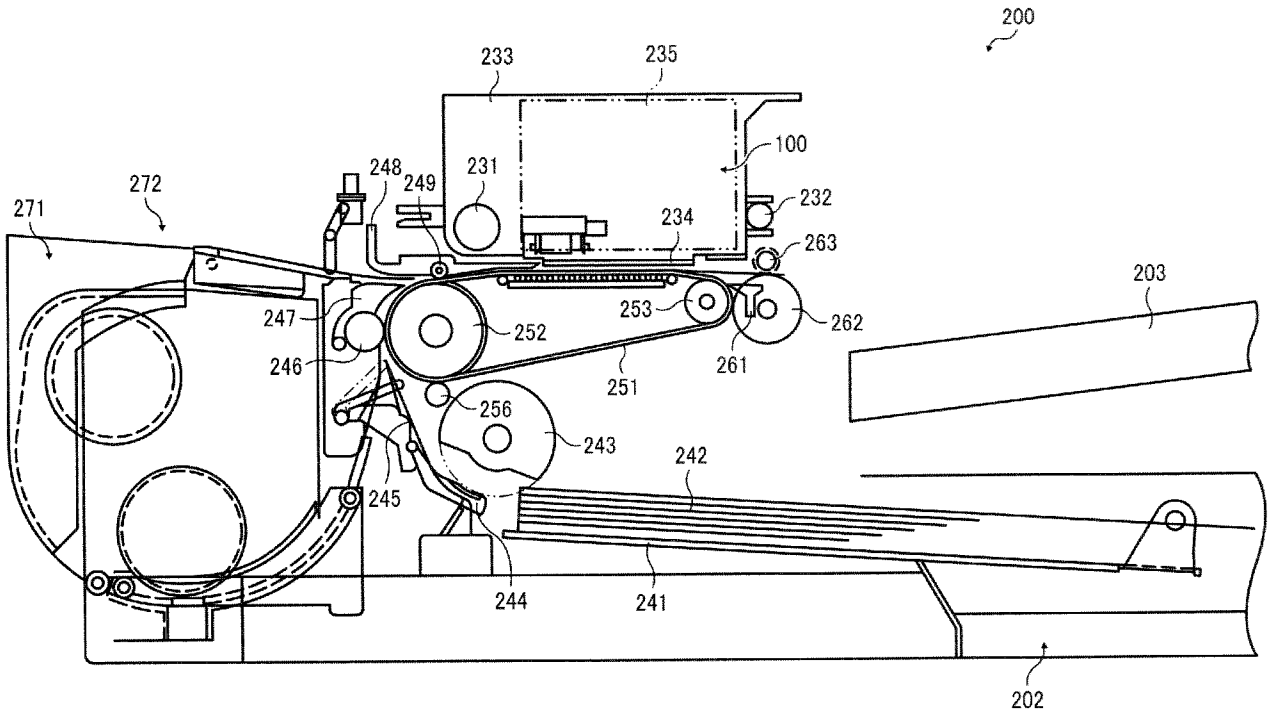
FIG. 56 is a vertical cross-sectional view illustrating an example of a configuration of an image forming apparatus according to illustrative embodiments.
Figure 57:
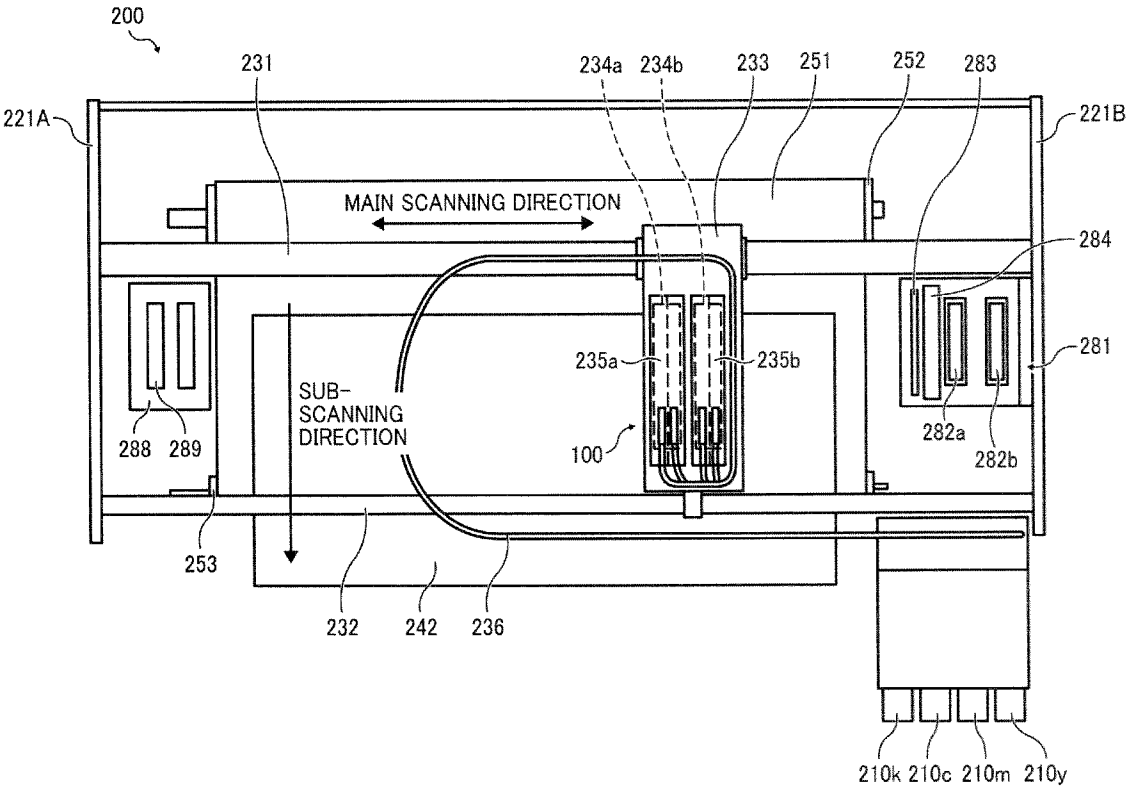
FIG. 57 is a schematic plan view illustrating an example of a configuration of a mechanism included in the image forming apparatus illustrated in FIG. 56.

A description is now given of an example of a configuration and operation of an image forming apparatus 200 including the liquid ejection head 100 according to illustrative embodiments, with reference to FIGS. 56 and 57. FIG. 56 is a vertical cross-sectional view illustrating an example of a configuration of the image forming apparatus 200 according to illustrative embodiments. FIG. 57 is a schematic plan view illustrating an example of a configuration of a mechanism included in the image forming apparatus 200.

The image forming apparatus 200 is a serial-type image forming apparatus, and a carriage 233 is slidably supported by guide rods 231 and 232 extended between left and right lateral plates 221A and 221B in a main scanning direction. The carriage 233 is reciprocally movable back and forth in the main scanning direction by a main scanning motor, not shown, via a timing belt.

The liquid ejection head 100 that ejects ink droplets of a specific color, that is, yellow (Y), cyan (C), magenta (M), or black (K), and a sub-tank 235*a* or 235*b* that supplies ink to the liquid ejection head 100 are formed together as a single integrated recording head 234*a* or 234*b*. The recording heads 234*a* and 234*b* (hereinafter collectively referred to as recording heads 234) are mounted on the carriage 233. The nozzle arrays each constituted of the multiple nozzles 11 are provided to the nozzle face of each of the recording heads 234 and arrayed in a sub-scanning direction perpendicular to the main scanning direction, such that the recording heads 234 eject ink droplets of the specified colors vertically downward.

Specifically, the image forming apparatus 200 includes the two recording heads 234*a* and 234*b* mounted on a single base member, and each of the recording heads 234*a* and 234*b* has two nozzle arrays. Black ink droplets (K) are ejected from a first nozzle array formed in the recording head 234*a*, and cyan ink droplets (C) are ejected from a second nozzle array formed therein. Similarly, magenta ink droplets (M) are ejected from a first nozzle array formed in the recording head 234*b*, and yellow ink droplets (Y) are ejected from a second nozzle array formed therein. Although the two recording heads 234 are provided to eject ink droplets of four different colors in the image forming apparatus 200, alternatively, four recording heads each ejecting ink droplets of a single color may be provided to the image forming apparatus 200.

The sub-tanks 235*a* and 235*b* (hereinafter collectively referred to as sub-tanks 235) each supplying ink of the specified color to the recording heads 234*a* or 234*b* are mounted on the carriage 233. The ink is supplied from an ink cartridge 210*k*, 210*c*, 210*m*, or 210*y* to the sub-tanks 235 of the recording heads 234 through supply tubes 236 by a supply unit, not shown.

The image forming apparatus 200 further includes a sheet feed roller 243 and a separation pad 244, both of which separate sheets 242 placed on a sheet stand 241 of a sheet feed tray 202 to feed the sheets 242 one by one from the sheet feed tray 202 to the recording heads 234. The separation pad 244 is disposed opposite the sheet feed roller 243 to be pressed against the sheet feed roller 243, and is formed of a material having a larger frictional factor than the sheet feed roller 243.

The sheet 242 fed from the sheet feed tray 202 is conveyed to the recording heads 234 by a guide member 245 that guides the sheet 242, a counter roller 246, a conveyance guide member 247, a pressing member 248 having a pressing roller 249, and a conveyance belt 251 that electrostatically attracts the sheet 242 to convey the sheet 242 to the recording heads 234.

The conveyance belt 251 is formed of an endless belt and is wound around a conveyance roller 252 and a tension roller 253 to be rotated in the sub-scanning direction. A charging roller 256 contacts a top layer of the conveyance belt 251 to charge the conveyance belt 251 and is rotated by the rotation of the conveyance belt 251. The conveyance roller 252 is rotatively driven by a sub-scanning motor, not shown, via a timing belt to rotate the conveyance belt 251 in the sub-scanning direction, that is, a direction of conveyance of the sheet 242.

The image forming apparatus 200 further includes a separation pick 261 that separates the sheet 242 from the conveyance belt 251, and discharge rollers 262 and 263 so that the sheet 242 having an image thereon is discharged from the image forming apparatus 200 to a discharge tray 203 disposed below the discharge roller 262.

A duplex unit 271 is detachably attachable to a rear side of the image forming apparatus 200. The duplex unit 271 reverses the sheet 242 conveyed by reverse rotation of the conveyance belt 251 and conveys the sheet 242 between the counter roller 246 and the conveyance belt 251 again. An upper surface of the duplex unit 271 serves as a manual sheet feed tray 272.

A servicing mechanism 281 that services the nozzles 11 in the recording heads 234 is provided outside the imaging range of the recording heads 234 at one end of the main scanning direction of the carriage 233 to prevent irregular ejection of the ink droplets from the nozzles 11 of the recording heads 234. The servicing mechanism 281 is constructed of caps 282*a* and 282*h*, each of which covers the nozzle face of the recording head 234, a wiper blade 283 that wipes off the nozzle face, and a receiver 284 that receives ink droplets which are not used for image formation and are ejected from the nozzles 11 to remove coagulated ink from the nozzles 11.

The image forming apparatus 200 further includes an ink receiver 288 that receives ink droplets not used for image formation and preliminarily ejected from the recording heads 234 to remove coagulated ink from the recording heads 234 during image formation. The ink receiver 288 is disposed outside the imaging range of the recording heads 234 at the other end of the main scanning direction of the carriage 233 and includes an opening 289 formed along the direction of the nozzle arrays in the recording heads 234.

The sheet 242 fed from the sheet feed tray 202 is guided vertically upward by the guide member 245 and conveyed by the conveyance belt 251 and the counter roller 246. The leading edge of the sheet 242 is further guided by the conveyance guide member 247 and is pressed against the conveyance belt 251 by the pressing roller 249 so that the direction of conveyance of the sheet 242 is changed substantially at 90°.

At that time, positive and negative voltages are applied alternately to the charging roller 256, that is, an alternating voltage is applied to the charging roller 256, from a voltage applicator, not shown, so that the conveyance belt 251 is charged in a pattern of an alternate charging voltages, that is, the conveyance belt 251 is alternately charged by positive and negative voltages with a predetermined width, in the direction of rotation of the conveyance belt 251 or the sub-scanning direction. Accordingly, the sheet 242 conveyed to the conveyance belt 251 thus alternately charged with the positive and negative voltages is electrostatically attracted to the conveyance belt 251 and is further conveyed in the sub-scanning direction by the rotation of the conveyance belt 251.

The recording heads 234 are driven based on image signals while the carriage 233 is moved so that ink droplets are ejected from the recording heads 234 onto the sheet 242, which remains stationary, so as to form a single line of an image to be formed on the sheet 242. Thereafter, the sheet 242 is conveyed by a predetermined amount to perform image formation of the next line. When receiving a completion signal or a signal which indicates that a trailing edge of the sheet 242 reaches the imaging range, the image forming apparatus 200 completes image formation to discharge the sheet 242 to the discharge tray 203.

Thus, the image forming apparatus 200 including the recording heads 234 each constructed of the liquid ejection head 100 according to the foregoing illustrative embodiments can provide secure ejection performance, thereby achieving higher image quality.

It is to be noted that the foregoing illustrative embodiments are applicable not only to the serial-type image forming apparatuses but also to line-type image forming apparatuses.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed:

1. A liquid ejection head comprising:

a nozzle plate having a nozzle array constructed of multiple nozzles from which liquid droplets are ejectable;

a channel plate in which grooves that form part of multiple pressure chambers respectively communicating with the multiple nozzles are provided with partition walls interposed between the grooves;

a wall member that covers the grooves to form part of walls of the pressure chambers, the nozzle plate, the channel plate and the wall member being laminated together in a laminating direction, and the multiple pressure chambers guiding fluid in a lateral direction perpendicular to the laminating direction of the nozzle plate the channel plate and a wall member; and multiple first through-holes formed in the channel plate thickness of the channel plate to connect the multiple nozzles and the multiple pressure chambers, respectively, the multiple first through-holes being provided with partition walls interposed therebetween, each of the multiple first through-holes having a first opening facing the wall member and a second opening facing the nozzle plate, the second opening being offset from the first opening in a direction in which the nozzle arrays extend perpendicular both to the lateral direction and to the laminating direction of the nozzle plate the channel plate and a wall member, each of the multiple first through-holes further having a portion between the first and second openings to change a direction of flow of liquid.

2. The liquid ejection head according to claim 1, further comprising multiple second through-holes formed in the channel plate throughout the thickness of the channel plate to form part of channels through which the liquid is supplied to the pressure chambers, the multiple second through-holes being provided with partition walls interposed therebetween, each of the multiple second through-holes having a first opening facing the wall member and a second opening facing the nozzle plate, the second opening being offset from the first opening in the direction in which the nozzle arrays extend, each of the multiple second through-holes further having a portion between the first and second openings to change the direction of flow of the liquid, wherein the second openings of the first and second through-holes are offset from the first openings of the first and second through-holes, respectively, in one of the same direction and opposite directions in the direction in which the nozzle arrays extend.

3. An image forming apparatus comprising the liquid ejection head according to claim 1.

4. The liquid ejection head according to claim 1, wherein each of the first through-holes is bent or curved at a bent portion, and the bent portion is disposed between a corresponding pair of the partition walls between the nozzle plate and wall member.

5. A liquid ejection head comprising:

a nozzle plate having a nozzle array constructed of multiple nozzles from which liquid droplets are ejectable;

a channel plate in which grooves that form part of multiple pressure chambers respectively communicating with the multiple nozzles are provided with partition walls interposed between the grooves;

a wall member that covers the grooves to form part of walls of the pressure chambers the nozzle plate, the channel plate and the wall member being laminated together in a laminating direction, and the multiple pressure chambers guiding fluid in a lateral direction perpendicular to the laminating direction of the nozzle plate, the channel plate and a wall member; and multiple first through-holes formed in the channel plate throughout a thickness of the channel plate to connect the multiple nozzles and the multiple pressure chambers, respectively, the multiple first through-holes being provided with partition walls interposed therebetween, each of the multiple first through-holes having a first opening facing the wall member and a second opening facing the nozzle plate, the second opening being offset from the first opening in a direction perpendicular to a direction in which the nozzle arrays extend, each of the multiple first through-holes further having a portion between the first and second openings to change a direction of flow of liquid, the second openings of two adjacent first through-holes are offset from the first openings in opposite directions, respectively, in the direction perpendicular to the direction in which the nozzle arrays extend, such that one of the second openings is offset from the corresponding first opening in the same direction as the direction of flow of the liquid to be supplied to the nozzles in the corresponding pressure chambers, and the other one of the second openings is offset from the corresponding first opening in a direction opposite to the direction of flow of the liquid to be supplied to the nozzles in the corresponding pressure chambers.

6. The liquid ejection head according to claim 5, wherein each of the multiple first through-holes is bent or curved at a bent portion.

7. An image forming apparatus comprising the liquid ejection head according to claim 5, and a liquid supplying unit configured to supply liquid to the liquid ejection head.

8. A liquid ejection head comprising:

a nozzle plate having a nozzle array constructed of multiple nozzles from which liquid droplets are ejectable;

a channel plate in which grooves that form part of multiple pressure chambers respectively communicating with the multiple nozzles are provided with partition walls interposed between the grooves;

a wall member that covers the grooves to form part of walls of the pressure chambers;

multiple first through-holes formed in the channel plate throughout a thickness of the channel plate to connect the multiple nozzles and the multiple pressure chambers, respectively, the multiple first through-holes being provided with partition walls interposed therebetween, each of the multiple first through-holes having a first opening facing the wall member and a second opening facing the nozzle plate, the second opening being offset from the first opening in direction perpendicular to a direction in which the nozzle arrays extend, each of the multiple first through-holes further having a portion between the first and second openings to change a direction of flow of liquid; and multiple second through-holes formed in the channel plate throughout the thickness of the channel plate to form part of channels through which the liquid is supplied to the pressure chambers, the multiple second through-holes being provided with partition walls interposed therebetween, each of the multiple second through-holes having a first opening facing the wall member and a second opening facing the nozzle plate, the second opening being offset from the first opening in the direction perpendicular to the direction in which the nozzle arrays extend, each of the multiple second through-holes further having a portion between the first and second openings to change the direction of flow of the liquid, in each of the pressure chambers, the second openings of the first and second through-holes being offset from the first openings of the first and second through-holes, respectively, either toward or away from each other in the direction perpendicular to the direction in which the nozzle arrays extend, wherein, in one of two adjacent pressure chambers, the second openings of the first and second through-holes are offset from the first openings of the first and second through-holes, respectively, toward each other in the direction perpendicular to the direction in which the nozzle arrays extend, and in the other one of the two adjacent pressure chambers, the second openings of the first and second through-holes are offset from the first openings of the first and second through-holes, respectively, away from each other in the direction perpendicular to the direction in which the nozzle arrays extend.

9. The liquid ejection head according to claim 8, wherein the two adjacent pressure chambers are offset from each other in a direction opposite the direction in which the second openings of the first and second through-holes are offset from the first openings of the first and second through-holes.

10. The liquid ejection head according to claim 8, wherein each of the multiple first through-holes is bent or curved at a bent portion, and wherein each of the multiple second through-holes is bent or curved at a bent portion.

11. An image forming apparatus comprising the liquid ejection head according to claim 8, and a liquid supplying unit configured to supply liquid to the liquid ejection head.

* * * * *